US007593682B2

(12) United States Patent
Tokumasu et al.

(10) Patent No.: US 7,593,682 B2
(45) Date of Patent: Sep. 22, 2009

(54) IMAGE FORMING APPARATUS, IMAGE FORMING METHOD, AND PROCESS CARTRIDGE

(75) Inventors: Takahiko Tokumasu, Atsugi (JP); Kenji Sugiura, Yokohama (JP); Takuya Seshita, Hiratsuka (JP); Daichi Yamaguchi, Hino (JP)

(73) Assignee: Ricoh Company, Ltd., Tokyo (JP)

( * ) Notice: Subject to any disclaimer, the term of this patent is extended or adjusted under 35 U.S.C. 154(b) by 362 days.

(21) Appl. No.: 11/376,132

(22) Filed: Mar. 16, 2006

(65) Prior Publication Data

US 2006/0210334 A1 Sep. 21, 2006

(30) Foreign Application Priority Data

Mar. 16, 2005 (JP) ..... 2005-074351

(51) Int. Cl.
*G03G 21/00* (2006.01)

(52) U.S. Cl. ..... 399/346; 399/71; 399/343

(58) Field of Classification Search ..... 399/71, 399/346, 343
See application file for complete search history.

(56) References Cited

U.S. PATENT DOCUMENTS

| | | | | |
|---|---|---|---|---|
| 2003/0044201 | A1* | 3/2003 | Kosuge | 399/223 |
| 2005/0191099 | A1 | 9/2005 | Yamaguchi et al. | |
| 2007/0166087 | A1 | 7/2007 | Yamaguchi et al. | |
| 2007/0212139 | A1 | 9/2007 | Sugiura et al. | |
| 2007/0218383 | A1 | 9/2007 | Seshita et al. | |
| 2007/0218385 | A1 | 9/2007 | Kojima et al. | |
| 2008/0070148 | A1 | 3/2008 | Awamura et al. | |
| 2008/0076055 | A1 | 3/2008 | Sawada et al. | |
| 2009/0074467 | A1 | 3/2009 | Seshita et al. | |

FOREIGN PATENT DOCUMENTS

| | | |
|---|---|---|
| JP | 10-142897 | 5/1998 |
| JP | 10-312098 | 11/1998 |
| JP | 2001-051571 | 2/2001 |
| JP | 2001-228668 | 8/2001 |
| JP | 2002-006689 | 1/2002 |
| JP | 2002-055580 | 2/2002 |
| JP | 2002-156877 | 5/2002 |
| JP | 2002-229227 | 8/2002 |
| JP | 2002-244516 | 8/2002 |
| JP | 2002-357983 | 12/2002 |
| JP | 3507277 | 12/2003 |

* cited by examiner

*Primary Examiner*—David M Gray
*Assistant Examiner*—Ryan D Walsh
(74) *Attorney, Agent, or Firm*—Oblon, Spivak, McClelland, Maier & Neustadt, L.L.P.

(57) ABSTRACT

An image forming apparatus including an image bearing member, a charging device, a transfer device, a lubricant supplying device, a developing device to develop the latent image with a developer, a discharging device, a cleaning device, and a controlling device configured to control an lubricant supplying mode and a lubricant removing mode in which at least a portion of the lubricant is removed from the surface of the image bearing member, a method of using the image forming apparatus, and a process cartridge used with the image forming apparatus.

12 Claims, 13 Drawing Sheets

IMAGE FORMING APPARATUS, IMAGE FORMING METHOD, AND PROCESS CARTRIDGE

BACKGROUND OF THE INVENTION

1. Field of the Invention

The present application relates to an image forming apparatus, an image forming method and a process cartridge for use in facsimile machines, photocopiers and printers.

2. Discussion of the Background

Unexamined published Japanese patent application No. (hereinafter referred to as JOP) 2001-054571 describes an image forming apparatus developed to restrain the occurrence of image blur to provide a long-life image bearing member. Image blur is caused by accumulation of nitrogen oxides ascribable to a lubricant supplied to the surface of an image bearing member. The image forming apparatus has a structure in which a lubricant supplying device supplies a lubricant to a photoreceptor functioning as an image bearing member to make the friction coefficient of the surface of the photoreceptor low. A process of reducing the surface friction coefficient of the photoreceptor and a process of increasing the surface friction coefficient of the photoreceptor are described. In the process of increasing the surface friction coefficient of the photoreceptor, nitrogen oxides produced during charging are removed. In the process of increasing the friction coefficient of the surface of the photoreceptor, for example, the contact pressure of the cleaning blade to the photoreceptor is greater than in the process of decreasing the surface friction coefficient.

In the technology described above, the surface friction coefficient of the photoreceptor is altered by changing, for example the contact pressure of the cleaning blade, to remove nitrogen oxides produced during charging. However, it was found recently that it is difficult to prevent deterioration of image quality such as image blur simply by removing the nitrogen oxides. In addition, in the technology described above, there is no mention that the lubricant protects a photoreceptor. Also there is no mention that the lubricant may be deteriorated by charging.

Further, JOP 2001-228668 describes an image forming apparatus in which a plurality of image bearing members are arranged along the transfer direction of a transfer material. Toner images formed on the surface of each image bearing member are transferred to the transfer material and the remaining toner attached to the surface of each image bearing member after the toner image is transferred to the transfer material is removed by a cleaning device. Further, a toner retrieving device is provided in the image forming apparatus to return the remaining toner removed by the cleaning device to the cleaning device and to prevent deterioration of image quality by paper dust contained in the remaining toner. That is, JOP 2001-228668 describes an image forming apparatus in which the toner retrieving devices are provided to the image bearing members except for the image bearing member disposed on the uppermost stream side from the transfer material. The toner retrieving devices are disposed between the cleaning devices to remove the remaining toner from the image bearing members and the developing devices. However, the technology described above does not refer to removal of the lubricant on the surface of the image bearing member.

In addition, JOP 2002-6689 describes an image forming apparatus in which a lubricant is supplied to the image bearing member on which toner images are formed to elongate the life of the image bearing member and to improve the image quality. Therein, the number of rotations n of the image bearing member is preset for the surface friction coefficient of the image. During image formation, when the number of the rotation of the image bearing member has reached a number n+A (A is an integer), the transfer current at the transfer portion is increased without performing image formation to increase the amount of the lubricant retrieved from the surface of the image bearing member. Thereby, the friction coefficient of the surface of the image bearing member is temporarily raised so that the product produced resulting from charging can be removed. After removing the product produced from the charging, the transfer current is returned to a level suitable for image formation and the image bearing member is rotated without forming images to apply the lubricant to the surface thereof up to a suitable amount. Thereby, the surface friction coefficient of the image bearing member is reduced. Thereafter, images are formed while applying the lubricant.

To raise the friction coefficient of the image bearing member, the technology described above describes a technology for removing nitrogen oxides together with the lubricant by changing the polarity of the transfer bias. It was recently found that it is difficult to prevent deterioration of image quality such as image blur simply by removing the nitrogen oxides. In addition, in the technology described above, there is no mention or concept that the lubricant protects a photoreceptor. Also there is no mention about deterioration of the lubricant by charging.

Further, JOP 2002-357983 describes a lubricant supplying device and an image forming device wherein the lubricant is used. In the device, the lubricant is sufficiently supplied without causing the increasing cost due to the increases of the mounting space of a member to supply the lubricant and the number of parts. The lubricant supply device is provided to supply the lubricant to the surface of a photoreceptor. The lubricant supply device has a blade-shaped member in which a lubricant is inclinationally dispersed in a rubber-like elastic member to make the lubricant present in a large quantity on one surface side than the other. In addition, the lubricant supply device supplies the lubricant to the surface of a photoreceptive drum by bringing the side of the blade-shaped member having the lubricant in a large amount into press-contact with the surface of the photoreceptor.

However, the technology does not refer to the method of supplying a lubricant to the photoreceptor in which the lubricant is contained in parts to dispense with the space for a solid or powder lubricant. In addition, there is no mention about removing the lubricant on the surface of the photoreceptor.

Applying a lubricant to a photoreceptor is also a means by which a protective layer may be added, such as of an image bearing member of an image forming apparatus to provide, for example, a long life of the image bearing member and quality images. The objects of the application of a lubricant are to prevent the occurrence of toner filming (fusion attachment), improve transfer efficiency by reducing the friction coefficient and prevent poor cleaning performance. JOPs 2002-244516, 2002-156877, 2002-55580, and 2002-244487 describe technologies related thereto.

JOP2002-229227 describes a technology to improve anti-abrasion property by applying a lubricant containing zinc stearate to a photoreceptor using a non-contact charging device to obtain a long-life charging member and photoreceptor. In the technology, organic particulates are dispersed in the photoreceptive layer of the photoreceptor. JOP H10-142897 describes an image forming apparatus having a blade form supplementary member. The blade form supplementary member is provided to even out the lubricant applied at the portion between the charging portion and the developing portion and to stem lubricants having a large particle diameter.

The widely-used known cleaning method for an image forming apparatus in typical electrophotography is a method in which a cleaning blade is used. There are a number of image forming apparatuses having only a blade as a cleaning device. In addition, in the case of a high speed electrophotographic machine, to avoid a state in which a large amount of toner is locally attached, an image forming apparatus is proposed in which a brush is provided on the upstream from the blade. However, such technologies have a drawback in that it is impossible to sufficiently remove the recently developed (polymerized) toner having a circularity of 0.96 to less than 1.00. In spite of this, there are short life image forming apparatuses which can remove such toner by giving some devise to toner and a blade. In addition, spherical (polymerized) toner has a high transfer ratio, meaning that the amount of the remaining toner is small. Therefore, there is proposed an image forming apparatus in which the developing device performs cleaning without a dedicated cleaning device.

In addition, a polarity control device provided on the upstream side from the cleaning device was used in an old-type image forming apparatus but few of them are now seen. One of the reasons is that such a polarity control device is no longer required due to improvements in cleaning technology and a desire for cost reduction. Among the cleaning devices having a brush on the upstream side from the blade, some cleaning devices also function as a polarity control device to which a voltage is applied but they are not popular. However, there are many image forming apparatuses having a polarity control device when the cleaning device mentioned above is not provided thereto.

As a charging device to charge the image bearing member of an image forming apparatus, the charging device using corona discharging used to be popular. However, this charging device using corona discharging has a drawback in that such a charging device produces ozone in a large amount. In addition, since a high power source is required to apply a voltage as high as 5 to 10 kV to perform corona discharging it is difficult to reduce cost of an image forming apparatus.

Therefore, contact type charging devices, in which a charging member contacts an image bearing member, have been adopted in many cases instead of a corona discharging device. This contact-type charging device can solve most of the drawbacks involved in the charging devices using the corona discharging mentioned above. On the other hand, the contact-type charging device invites problems such as abnormal images referred to as image deletion and increased abrasion of the image bearing member. In addition, when AC is used as an application voltage, noises occur, which also becomes a problem. In addition, the charging device rubs toner, paper dust, etc., with an image bearing member (photoreceptor), which accelerates contamination. Work-up in printing stemming from this contamination creates another printing problem. To solve these kinds of problems, JOP H10-312098 describes a technology in which the contamination due to toner and paper dust caused by a charging device mentioned above is prevented by controlling an applied voltage using a supplementary charging member and a charging member. In addition, by this technology, the occurrence of abnormal images referred to as positive-ghost in a cleaner-less system can be prevented.

As mentioned above, applying a lubricant to the image bearing member of an image forming apparatus is widely performed to improve transferability and/or cleanability. However, when an image bearing member is charged by a charging device having a charging member disposed in the vicinity of or contacting with the image bearing member, the lubricant on the image bearing member deteriorates due to the charging and the amount of the lubricant on the image bearing member decreases. As a result, it is difficult for the lubricant to carry out its function. Moreover, if the degraded lubricant is left on the image bearing member and not removed, the lubricant gradually accumulates. Thereby, the image quality deteriorates and abnormal images occur. There is a problem that typically used cleaning blades or cleaning brushes cannot sufficiently remove the degraded lubricant on the surface of the image bearing member by a charging device.

SUMMARY

Because of these reasons, the present applicants recognize that a need exists for an image forming apparatus, an image forming method and a process cartridge in which degraded lubricants are adequately removed to thereby improve the quality of images.

Accordingly, one object of the invention to provide an image forming apparatus which can prevent deterioration of the image quality and occurrence of abnormal images by eliminating degraded lubricant and remaining on the image bearing member by discharging the charging device thereto. Another object of the present invention is to provide an image forming apparatus which operates a controlling device to remove a lubricant on the surface of an image bearing member. A further object is to provide a process cartridge and an image forming method using the image forming apparatus.

These objects and the details of the present invention as hereinafter described will become more readily apparent and can be attained, either individually or in combination, by an image forming apparatus including an image bearing member to bear a latent image, a charging device to charge the image bearing member which includes a charging member disposed in the vicinity of, in contact with, or both in the vicinity of and in contact with the image bearing member, a transfer device to transfer the image to a transfer body, a lubricant supplying device to supply a lubricant to the surface of the image bearing member, disposed on the downstream side from the transfer device relative to the rotation direction of the image bearing member and on the upstream side from the charging member relative thereto, a developing device to develop the latent image with a developer, disposed on the downstream side from the charging member relative to the rotation direction of the image bearing member and on the upstream side from the transfer device relative thereto, a discharging device to discharge the image bearing member, a cleaning device to clean the surface of the image bearing member, and a controlling device to control a lubricant supplying mode and a lubricant removing mode in which the lubricant is removed from the surface of the image bearing member.

It is preferred that, in the image forming apparatus mentioned above, the cleaning device and the controlling device are provided to remove the lubricant applied to the surface of the image bearing member with the developer supplied from the developing device.

It is still further preferred that, in the image forming apparatus mentioned above, the lubricant removing mode of the controlling device is triggered based on an operation period of time or a number of printed images.

It is still further preferred that, in the image forming apparatus mentioned above, the image bearing member includes a protective layer as the surface layer.

It is still further preferred that, in the image forming apparatus mentioned above, the binder resin includes a binder resin which includes a cross-linkage structure.

It is still further preferred that, in the image forming apparatus mentioned above, the binder resin including a cross-linkage structure includes one or more charge transfer portions.

It is still further preferred that, in the image forming apparatus mentioned above, the cleaning device is provided to remove a degraded lubricant from the surface of the image bearing member.

As another aspect of the present application, an image forming method is provided which includes charging the surface of an image bearing member with a charging device, irradiating a portion of the image bearing member other than an image portion with light by an irradiating device to form a latent electrostatic image, developing an image by supplying a developer to the latent electrostatic image with a developing device, transferring the developed image to a transfer body by a transfer device, fixing the transferred image on the transfer body by a fixing device, discharging the image bearing member with a discharging device, supplying a lubricant to the surface of the image bearing member, removing the developer remaining on the surface of the image bearing member with a cleaning device, and controlling at least one of a lubricant supply mode and a lubricant removing mode to remove the lubricant on the image bearing member.

It is preferred that the image forming method mentioned above includes controlling the lubricant removing mode, discharging the the surface of the image bearing member with the discharging device such that a voltage of the image bearing member is close to 0 V in absolute value, and supplying the developer for removing the lubricant with the developing device to the surface of the image bearing member by applying a bias smaller in absolute value than a development bias applied thereto during image formation.

It is still further preferred that the image forming method mentioned above includes controlling the lubricant removing mode, supplying the developer to the image bearing member with the developing device with the same bias as the bias during the irradiating. In addition, a voltage (Vch) applied to the charging device is formed of only DC component while satisfying the following relationship (1):

$$|Vth| \leqq |Vch| \leqq |Vth| + |Vdev| \quad (1),$$

wherein, Vth represents a voltage when discharging starts, and Vdev represents a development bias, which is the applied voltage of the DC component to the developing device.

It is still further preferred that the image forming method mentioned above includes controlling the lubricant removing mode. In addition, the surface voltage of the image bearing member is the same as the surface voltage thereof during the irradiating, an applied voltage to the charging device contains only a DC component without an AC component, and the developing device supplies the developer to the image bearing member with a bias greater in absolute value than the bias during image formation.

It is still further preferred that the image forming method mentioned above includes controlling the lubricant removing mode, which is triggered based on an operation period of time or a number of printed images.

It is still further preferred that the supplying in the image forming method mentioned above includes applying the lubricant immediately after the lubricant is removed.

It is still further preferred that, in the image forming method, the lubricant removed from the surface of the image bearing member is a degraded lubricant.

As another aspect of the present application, a process cartridge is provided which includes an image bearing member to bear a latent electrostatic image, a developing device to develop the latent electrostatic image with a developer, a lubricant supplying device to supply a lubricant to the surface of the image bearing member, a discharging device to discharge the surface of the image bearing member, a cleaning device to clean the surface of the image bearing member, and optionally a charging device to charge the image bearing member. In addition, the discharging device and the cleaning device are provided to remove the lubricant with the developer supplied from the developing device, and the cleaning device is provided in a lubricant removing mode controlled by a controlling device in an image forming apparatus to which the process cartridge is detachably attached.

It is preferred that, in the process cartridge, the controlling device which controls the lubricant removing mode is based on an operation period of time or a number of printed images.

It is still further preferred that, in the process cartridge mentioned above, the lubricant removed with the developer supplied from the developing device is a degraded lubricant.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
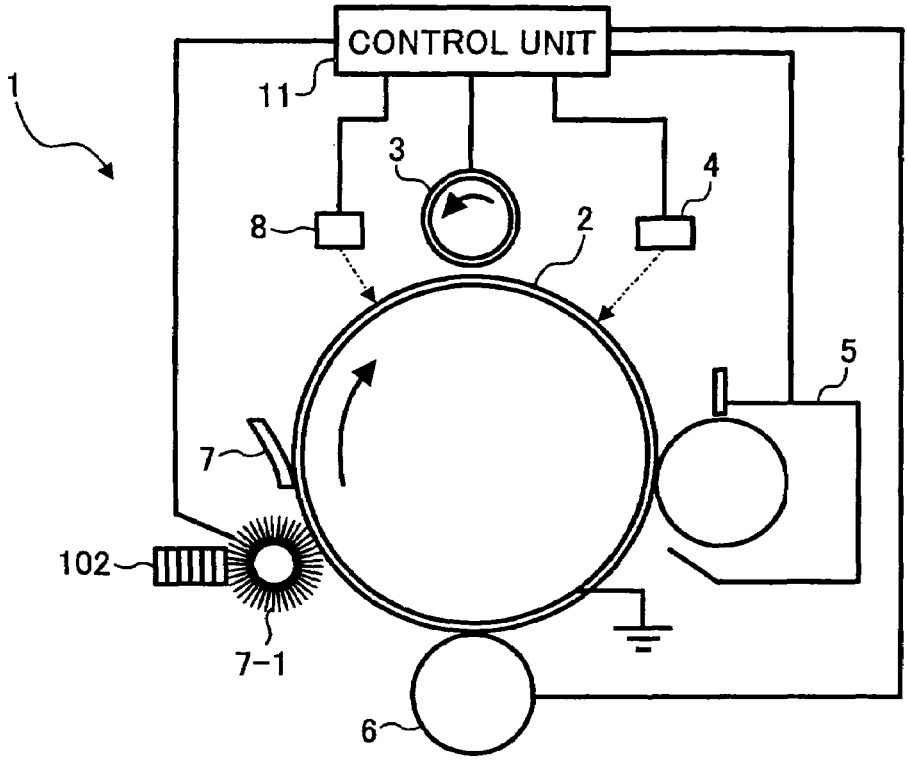
FIG. 1 is a schematic diagram illustrating an example of an image bearing member of the monochrome image forming apparatus of the present application.

Embodiments of the present invention will be described in detail below with reference to the drawing attached thereto.

Figure 10A:
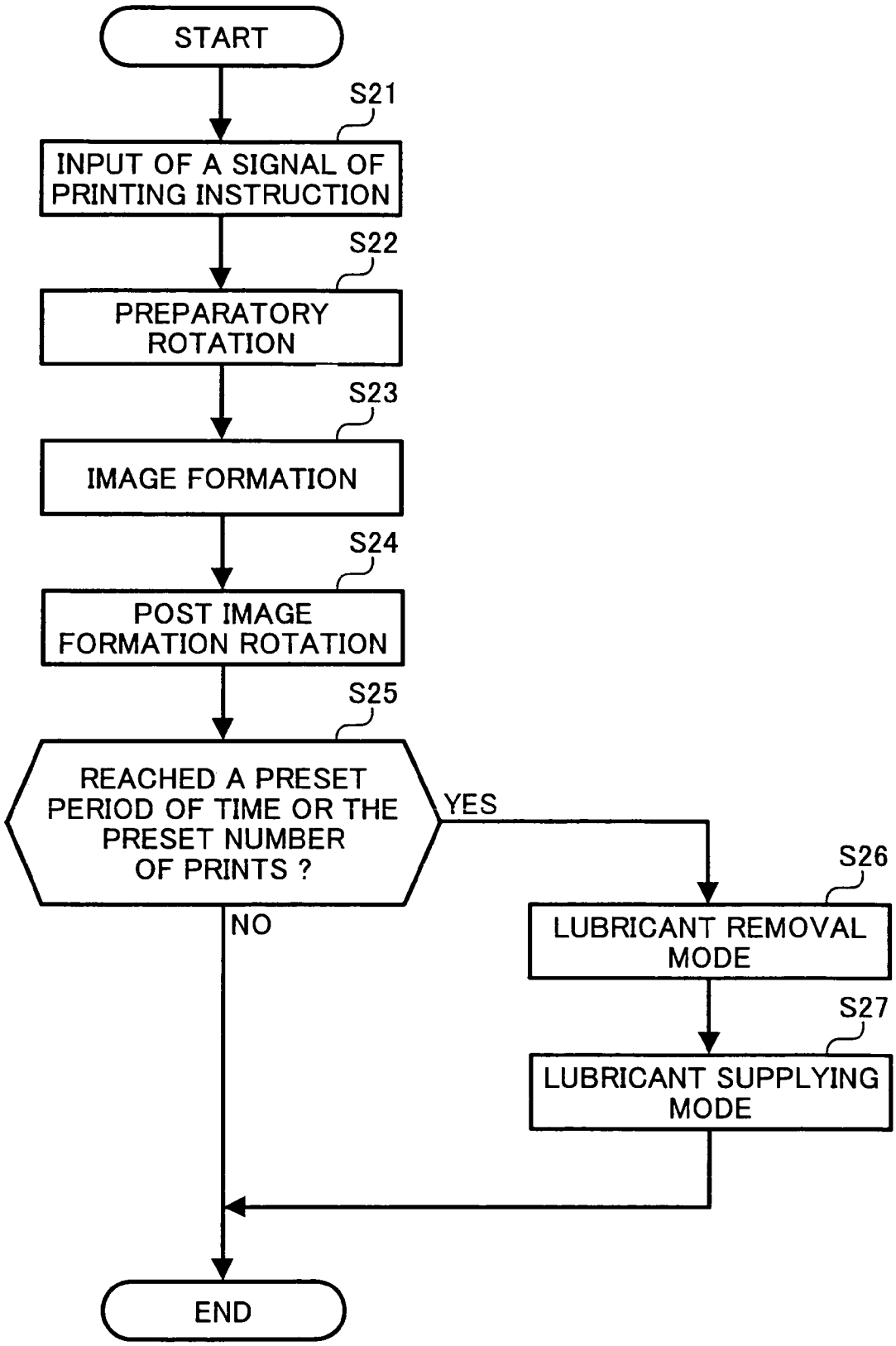
FIG. 10 is a high-level flow chart illustrating another example of the lubricant removing mode and lubricant supplying mode.
Figure 10B:
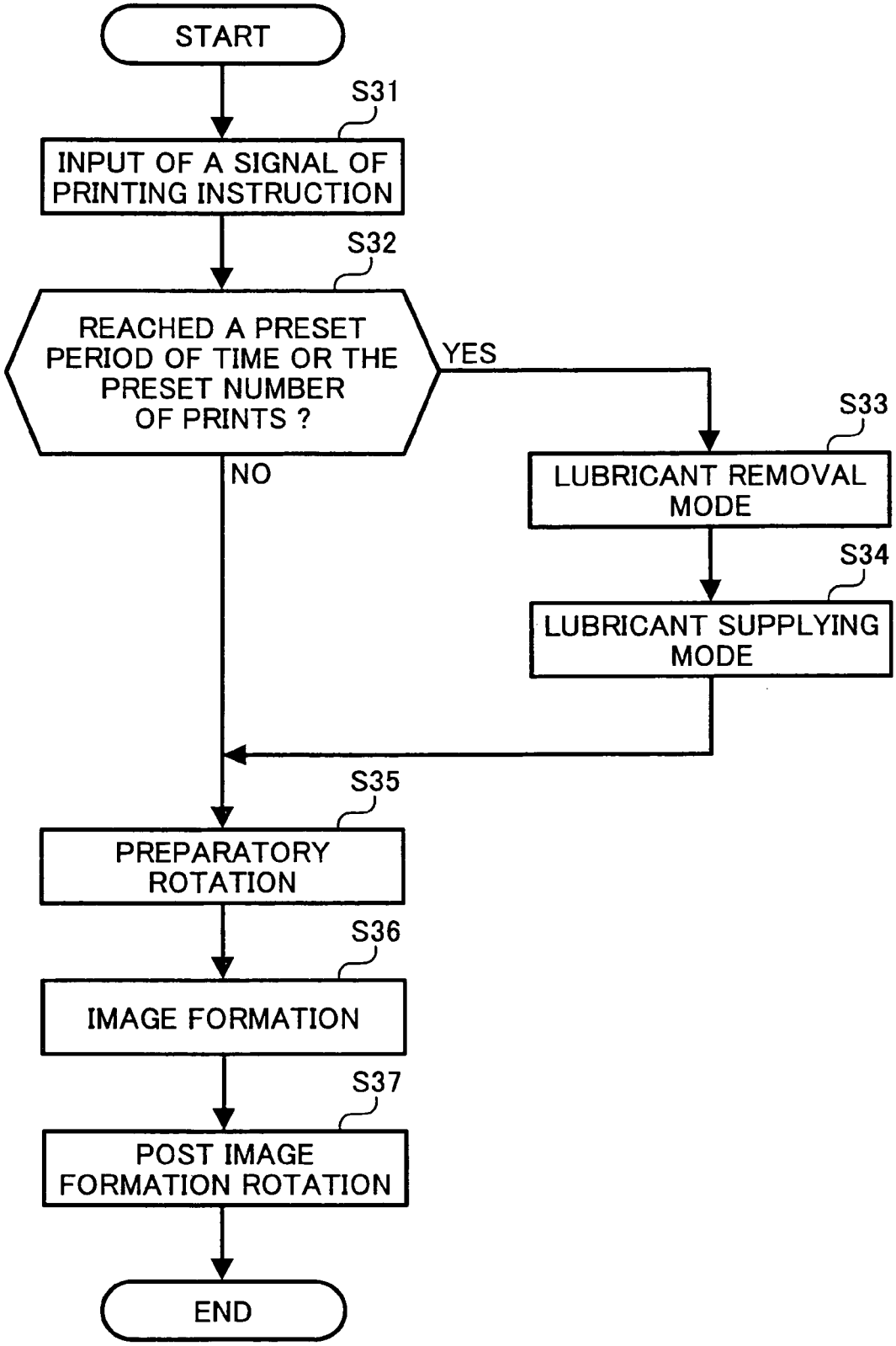
Figure 11:
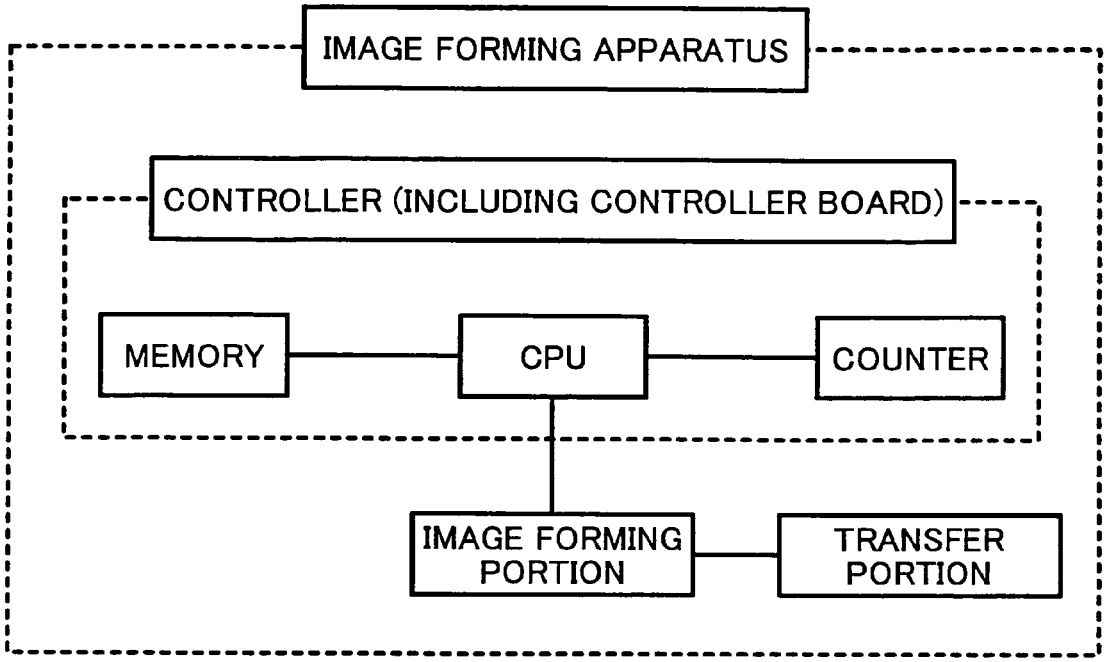
FIG. 11 is a high-level block chart illustrating an examples of the present application.
Figure 12:
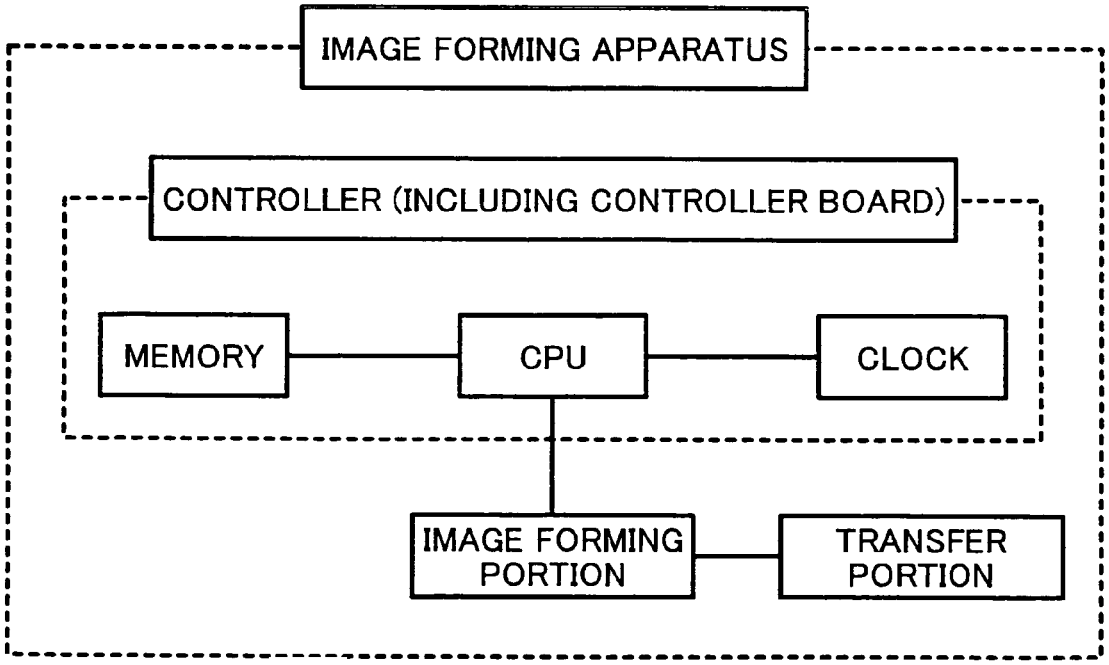
FIG. 12 is a high-level block chart illustrating another examples of the present application.
Figure 13:
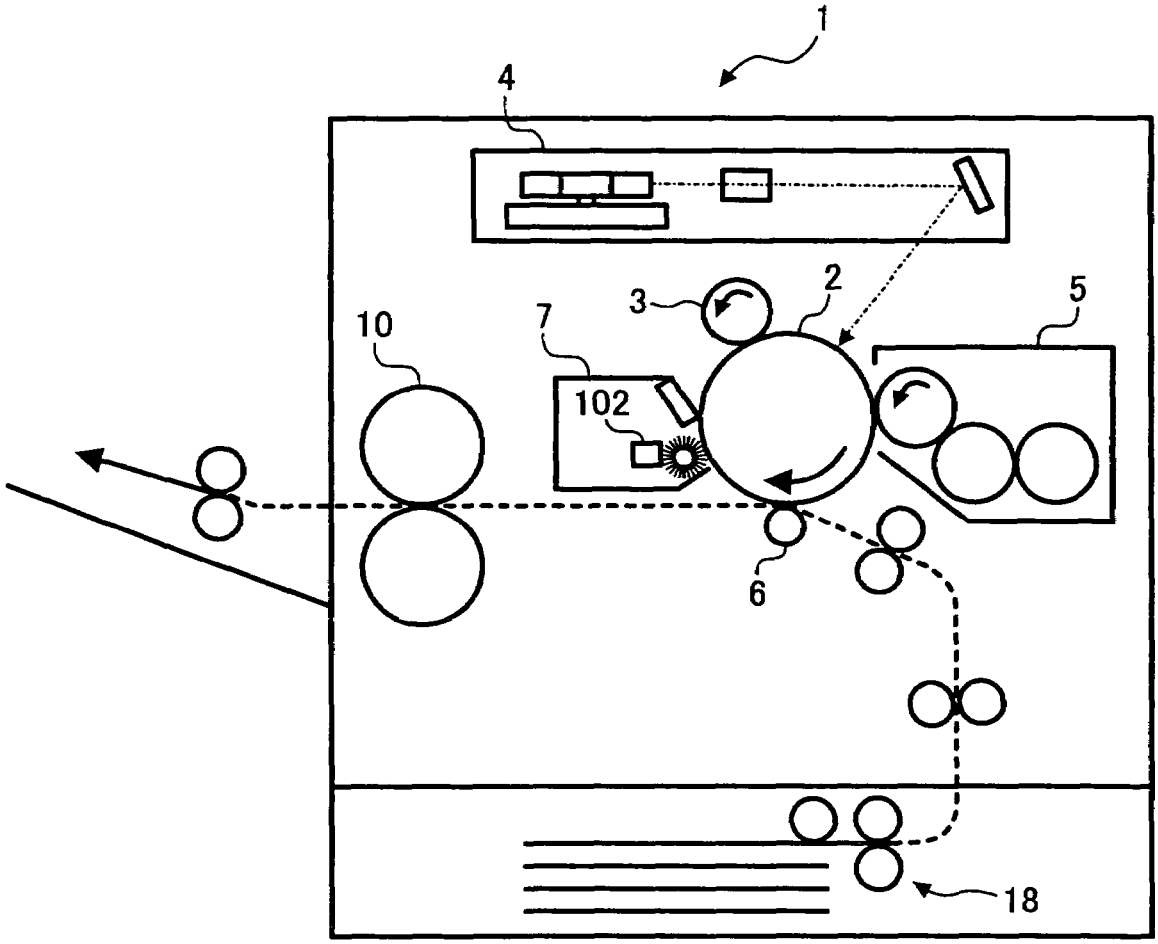
FIG. 13 is a diagram illustrating, in general terms, an example of the entire structure of a photocopier related to the present invention.
Figure 14:
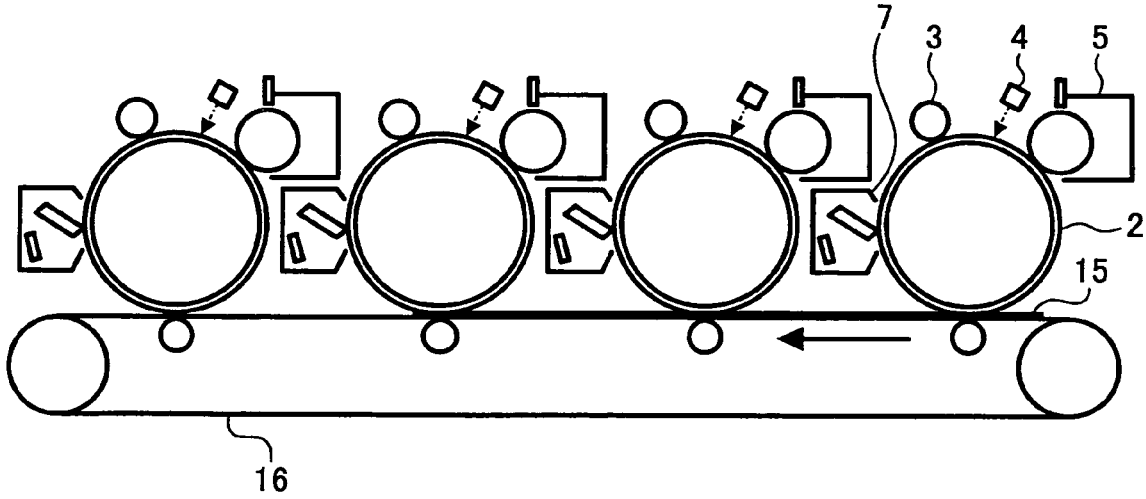
FIG. 14 is a schematic diagram illustrating an example of the color photocopier of the present application.
Figure 15:
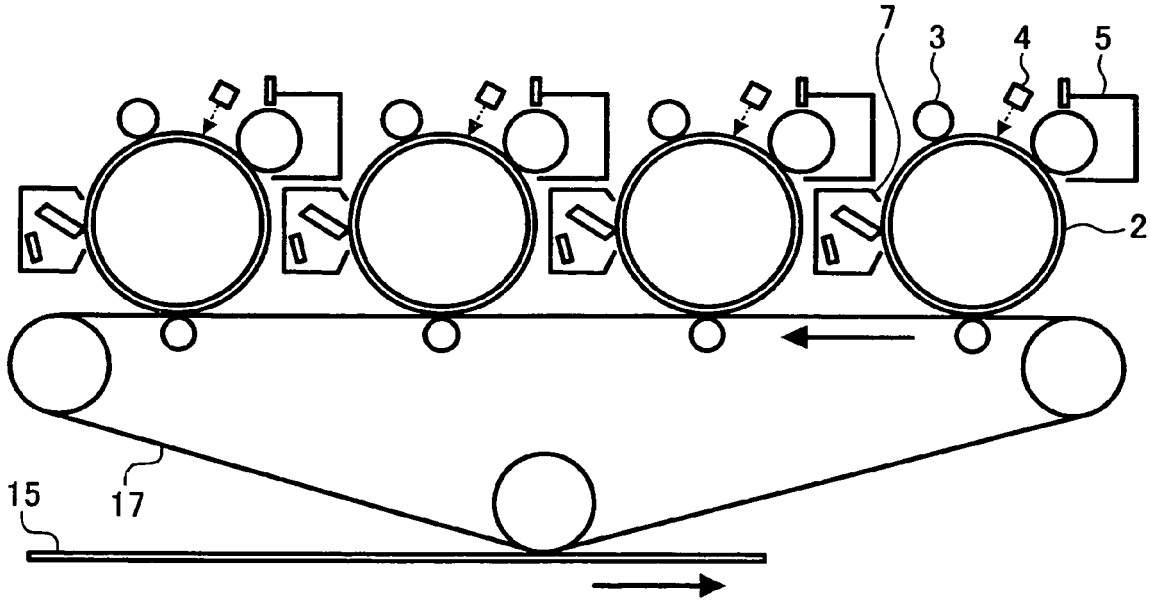
FIG. 15 is a schematic diagram illustrating another example of the color photocopier of the present application.

FIG. 13 is a diagram illustrating, in general high-level terms, the entire structure of the image forming apparatus (electrophotographic printer) of an embodiment of the present invention. In FIG. 13, a roller is adopted as a charging device 3 but a corona charger can be used as well. FIGS. 1 to 7 are schematic diagrams illustrating embodiments of the image bearing member and the structure around the image bearing member of a monochrome photocopier of the present application. In addition, FIGS. 14 and 15 are schematic diagrams illustrating a color photocopier based on the embodiments illustrated in FIGS. 1 to 7. FIG. 14 is a schematic diagram illustrating a color photocopier in which images are directly transferred to a recording material. FIG. 15 is a schematic diagram illustrating a color photocopier in which each color image is overlapped on an intermediate transfer body and thereafter the overlapped image is transferred to a recording material. FIGS. 9 and 10 are high-level flowcharts of the present application. FIGS. 11 and 12 are block charts illustrating embodiments of the structure of the present application.

General Description Of Photocopier

In FIG. 13, an image forming apparatus 1 is structured by an image bearing member 2 around which a charging device 3, a developing device 5, a transfer device 6 and a lubrication member 102 are disposed. In addition, an irradiating device 4 is disposed above the charging device 3. A paper feeding device 18 is provided to feed a recording material to between the transfer device 6 and the image bearing member 2. A fixing device 10 is provided to fix the transferred image on the recording material. Further, a cleaning device 7 is provided to clean the surface of the image bearing member 2.

The behavior of the image forming apparatus having such a structure is described below with reference to FIG. 13. In FIG. 13, the image forming apparatus includes the image bearing member 2 disposed in the main body thereof. This image bearing member 2 is structured by a drum form photoreceptor formed of an electroconductive base having a cylindrical form and a photosensitive layer on the outer surface thereof. An image bearing member having an endless form can be also adopted. Such an image bearing member is rotationally driven while suspended over multiple rollers. The image bearing member 2 is rotationally driven clockwise during image formation and is charged with a desired polarity by the charging device 3. In FIG. 13, a non-contact type charging roller is used but the charging device 3 is not limited thereto and a contact-type roller can be also used. The image bearing member 2 charged by the charging device 3 is irradiated with an optically modulated laser beam output by a laser writing unit, which is an example of the irradiating device 4. Thereby, a latent electrostatic image is formed on the image bearing member 2. The latent electrostatic image (image portion) is formed on a portion in the surface of the image bearing member 2 where the absolute voltage is lowered. The remaining portion, which is not irradiated with the laser beam so that the absolute voltage is kept high, forms the background portion. When the latent electrostatic image passes through the developing device 5, the latent electrostatic image is visualized by a toner charged with a desired polarity to form a toner image. It is also possible to use an irradiating device having LED arrays or an irradiating device in which a document side is irradiated and the document image is focused on an image bearing member.

A transfer material, e.g., transfer (recording) paper, is fed at a suitable timing from the paper feeding device 18 to between the image bearing member 2 and the transfer device 6 disposed opposing the image bearing member 2. Then, the toner image formed on the image bearing member 2 is electrostatically transferred to the transfer material. The transfer material on which the toner image is transferred passes through the fixing device 10, where the toner image is fixed on the transfer material upon application of heat and pressure. The transfer material which has passed through the fixing device 10 is discharged to a paper discharging portion. The toner which has not been transferred to the transfer material and remains on the surface of the image bearing member 2 is removed by the cleaning device 7. The fixing device 10 can be structured by, for example, two rollers, but can also have another structure formed by, for example, a belt and roller.

The developing device 5 illustrated in FIG. 13 includes a developer case accommodating a dry developer and a developing roller which transfers the developer while bearing the developer. A dry developer containing a toner and a carrier, or a single-component developer, which does not contain a carrier, can be used as a developer. When the developing roller is rotationally driven in the direction indicated by the arrow, the developer is borne thereon and transferred to the surface of the developing roller. The toner transferred to the developing area formed between the developing roller and the image bearing member 2 electrostatically moves towards the latent electrostatic image. That is, the latent electrostatic image is visualized as a toner image.

In addition, the transfer device 6 illustrated in FIG. 13 includes a transfer roller which is reversely charged based on the polarity of the charged toner on the image bearing member 2. Other transfer devices such as a transfer brush, transfer blade, and corona charger having a corona wire can be also used. Further, instead of directly transferring the toner image on the image bearing member to a transfer material serving as the final recording medium, the toner image on the image bearing member can be transferred to a final recording medium by way of a transfer material formed of an intermediate transfer body.

Furthermore, the cleaning device 7 illustrated in FIG. 13 includes a cleaning case, and cleaning members. The cleaning members include a fur brush 7-1 (illustrated in FIG. 1) rotationally supported by the cleaning case, and a cleaning blade 7. These cleaning members are brought in contact with the surface of the image bearing member 2 to remove the toner remaining on the surface after transfer.

The cleaning blade 7 functioning as a cleaning device can be formed of a material selected from known material such as polyurethane rubber, silicone rubber, nitrile rubber, and chloroprene rubber. The elasticity, thickness and pressure-contact angle to the image bearing member 2 of the material is suitably set for use. A discharging device can be used as illustrated in FIG. 1 (but not illustrated in FIG. 13) to discharge the residual potential of the image bearing member.

A lubricant supplying device is described below with reference to FIG. 1.

The lubricant of a lubrication member 102 is suitably supplied to the image bearing member 2 by the fur brush 7-1. Typically, the lubricant is continuously supplied but can be intermittently supplied by using a typical cam or electromagnetic clutch by which the lubrication member 102 can be attached to and detached from the fur brush 7-1. In addition, it is also possible to control the supply of the lubricant on a necessity basis by monitoring, for example, the torque of the image bearing member, the electric current of the driving motor, and the reflectivity of the image bearing member 2.

Figure 2:
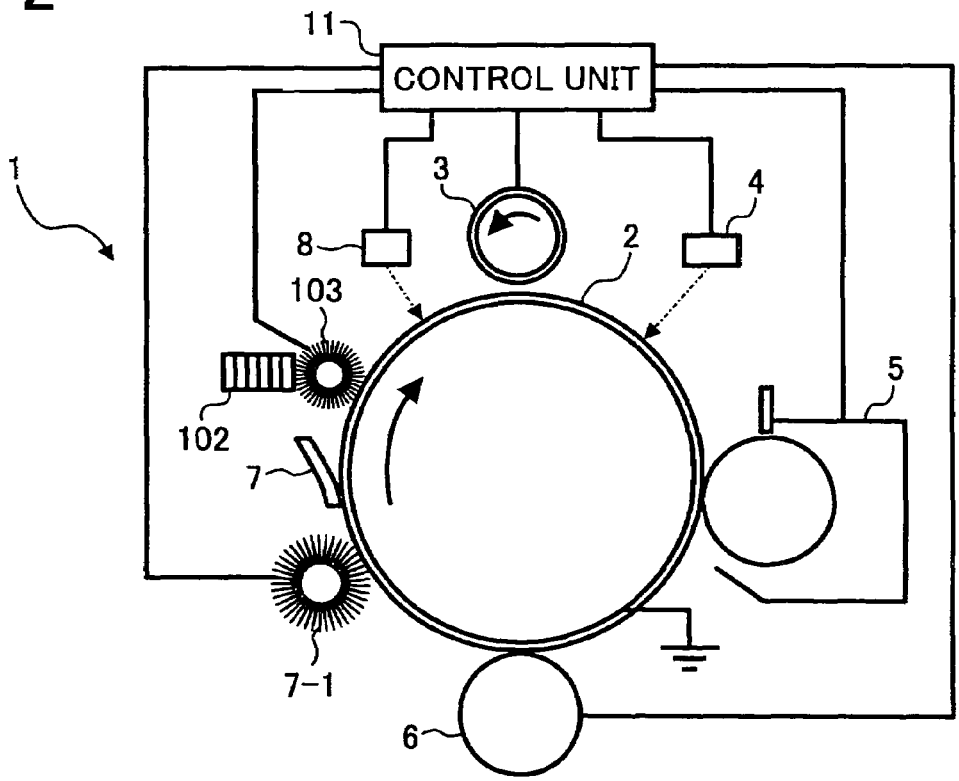
FIG. 2 is a schematic diagram illustrating another example of an image bearing member of the monochrome image forming apparatus of the present application.
Figure 3:
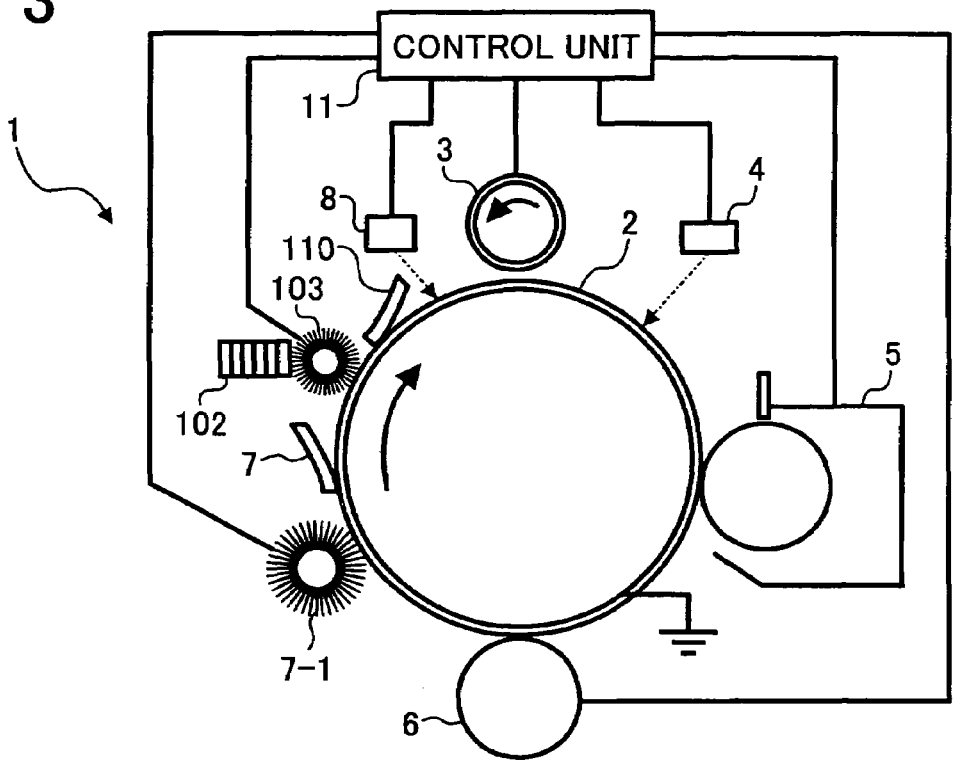
FIG. 3 is a schematic diagram illustrating another example of an image bearing member of the monochrome image forming apparatus of the present application.

Further, it is also possible to have a structure as illustrated in FIG. 2 in which a lubricant of the lubrication member can be supplied to the image bearing member 2 using a lubricant supplying device 103 instead of the fur brush 7-1. Furthermore, as illustrated in FIG. 3, a structure in which a lubricant uniforming device 110 is used to form a thin layer of the lubricant on the image bearing member 2 can be also used.

The lubricant uniforming device 103 preferably supplies a lubricant to the image bearing member 2 in such a manner that the lubricant is supplied via, for example, a rotation brush or a rotation roller which is in contact with a solid lubricant and the image bearing member. However, in terms of size reduction of a device and cost reduction, it is also possible to directly contact a lubricant with the image bearing member 2.

In this embodiment, a rotation brush is used as the lubricant supplying device. However, there is no specific limit to the lubricant supplying device. Therefore, using other members such as a rotation roller and a belt having an endless form does not cause any problem.

In addition, it is possible to use a metal salt of a fatty acid as a lubricant in a form of powder or solid depending on the supplying manner to an image bearing member. A solid form is preferred to a powder form considering the problems such as scattering. Specific examples of the metal elements forming such metal salts of a fatty acid include zinc, lithium, sodium, calcium, magnesium, aluminum, lead, and nickel. Specific examples of the fatty acids forming such metal salts of a fatty acid include stearic acid, lauric acid, and palmitic acid. Among them, when a solid lubricant is used in a form of a rectangular column, zinc stearate is preferred and when a powder lubricant having a sphere form is used, calcium stearate is preferred.

The lubricant removing mode and the lubricant supplying mode are described below. In the structure illustrated in FIG. 1 in which a lubricant having a small particle diameter is applied to the image bearing member 2 by the fur brush 7-1 and the lubricant having a small particle diameter is abraded by the cleaning blade 7, it is found to be difficult to form a thin layer of the lubricant based on the experiments performed by the present applicants. Also it is found that once a thin layer is formed, such a thin layer is not easily removed or peeled off.

Therefore, once a thin layer of a lubricant is formed when an image forming apparatus is used for the first time or when an image bearing member is exchanged, the thin layer can be maintained for a certain period of time when the structure mentioned above including the fur brush 7-1 and the cleaning blade 7 is used. The thickness of such a thin layer is little affected by the cleaning blade 7, which is constantly in contact with the image bearing member 2. However, since the lubricant is attached to the other devices in contact with the image bearing member 2, it is known that the variance of the layer thickness caused by direct charging by the charging device is large. Therefore, when a charging roller is used to charge the image bearing member 2, it is preferred to constantly apply the lubricant even after a protective layer is formed in the lubricant supplying mode mentioned above. In this case, when the transfer device 6 has a mechanism which can attach and detach the transfer device 6 to and from the image bearing member 2, it is preferred to detach the transfer device 6 from the image bearing member 2. Similarly, when the developing device 5 also has a mechanism which can attach and detach the developing device 5 to and from the image bearing member 2, it is preferred to detach the developing device 6 from the image bearing member 2 as well.

Description Of Experiment Results

Figure 17:
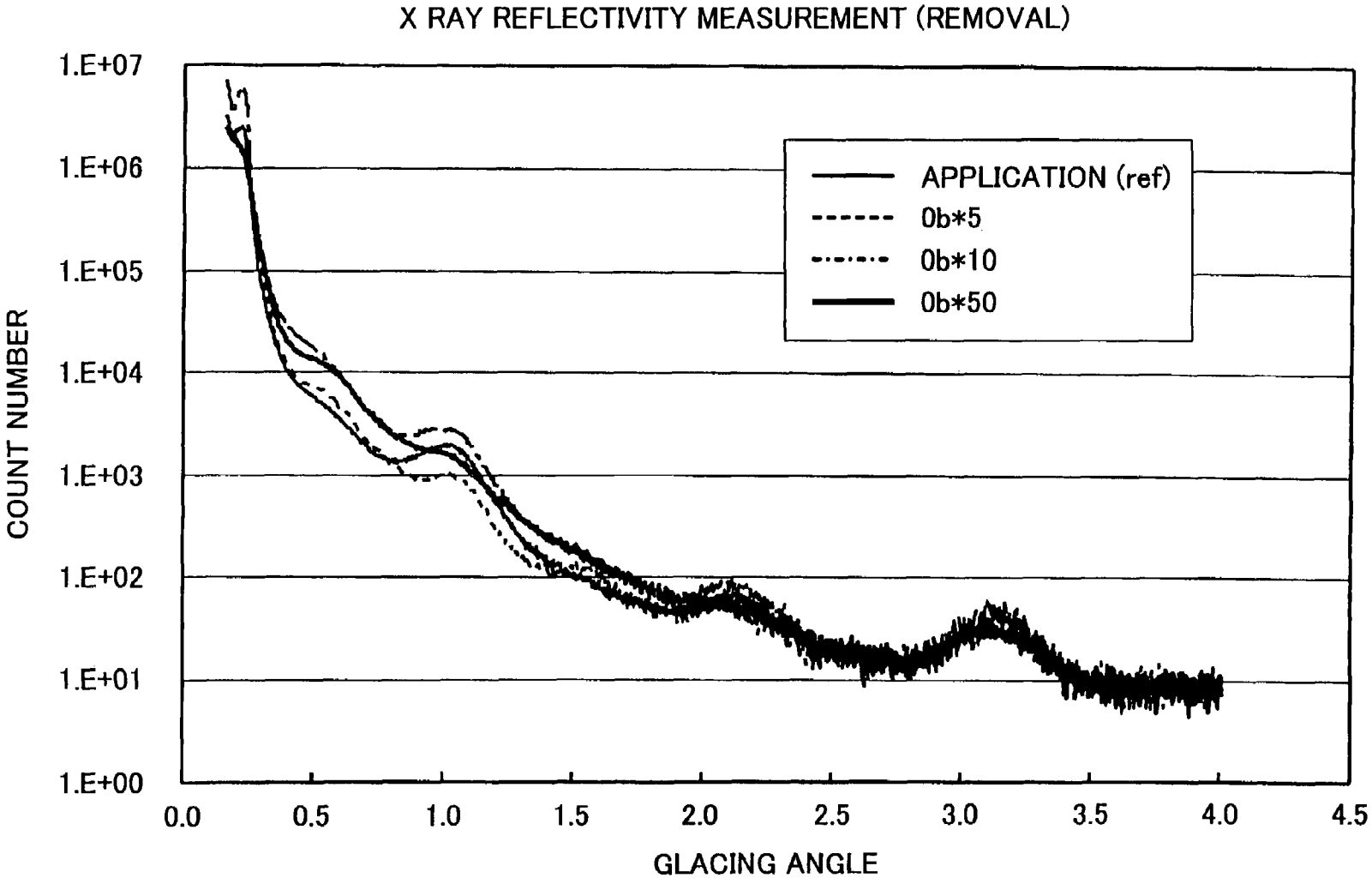
FIG. 17 is a graph illustrating one aspect of the relationship between the number of removal times of a lubricant from an image bearing member and the reflectivity thereof.
Figure 18:
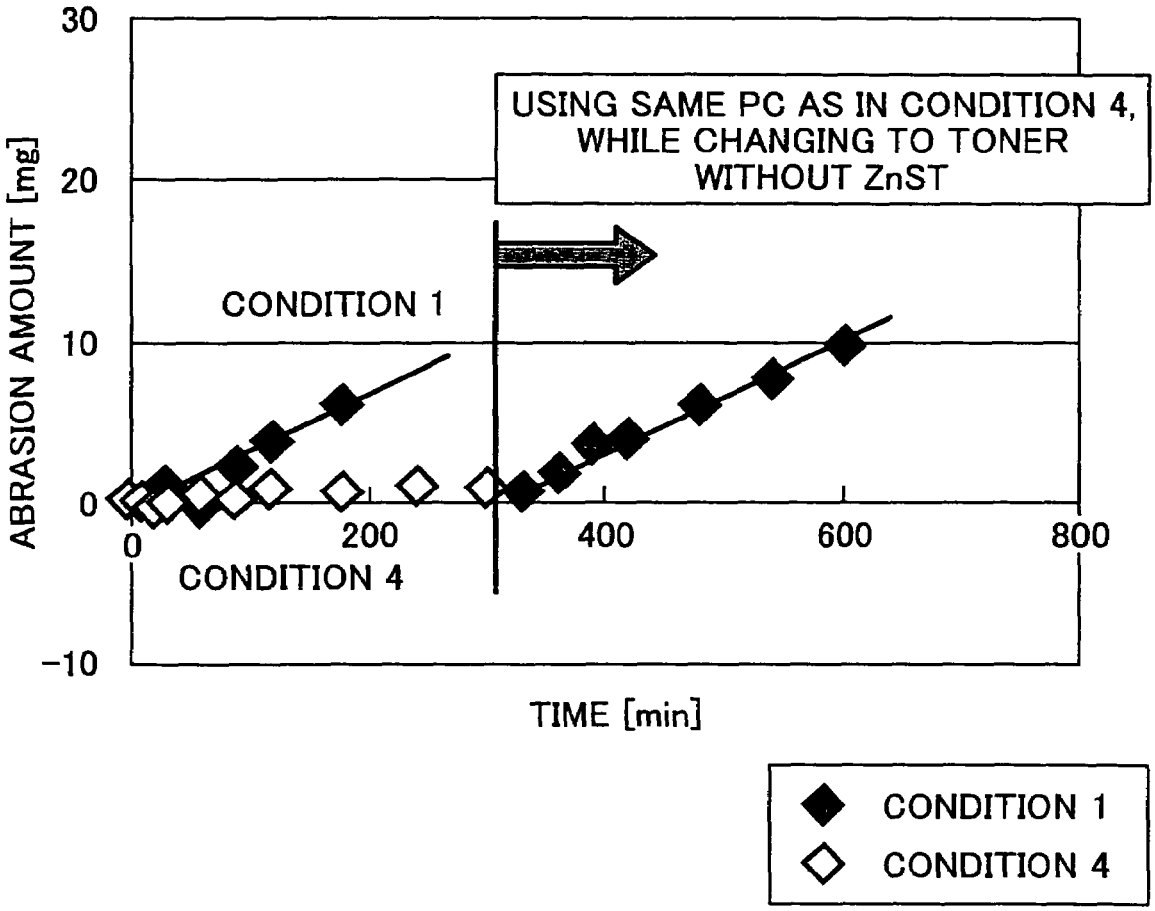
FIG. 18 is a graph illustrating one aspect of the relationship between the abrasion amount and the time obtained from the example shown later in which a polycarbonate substrate is abraded in mid-course with an abrasion wheel to which a toner having no lubricant thereon is attached.

The results of the experiments on the mechanism forming a thin layer on the photoreceptor serving as the image bearing member 2 are shown in Table 1, FIGS. 17 and 18.

TABLE 1

Measurement results of ZnST (zinc stearate) layer thickness on an Si substrate using an ellipsometer (ZnST is assumed to have a refractive index of 1.5 and absorption index of 0)

| (Brush + blade) Number of times | Layer thickness |
|---|---|
| 1 | 4.9 |
| 10 | 9.1 |
| 20 | 9.2 |
| 30 | 10.7 |

According to the results of this experiment, it is not easy to form a thin layer. In addition, it is found that once a thin layer is formed it is not easy to remove or peel off the thin layer. Therefore, when an image forming apparatus is used for the first time or when the image bearing member 2 is exchanged, it is possible to form a suitable thin layer by passing through a layer uniforming member (including an application brush and a uniforming blade) at least three times. The thus formed thin layer is found to have a good cleanability and the ability of preventing an adverse effect caused by charging. Especially, considering shortening the control time in the method of present application, sufficient application number of times of a lubricant to the image bearing member 2 are three to ten times.

The description will be made with reference to the experiments and the measuring results. As seen in Table 1, the average layer thickness is 4.9 nm after a lubricant is applied once. This my be insufficient because the layer is typically preferred to be formed of a two-molecular layer, which has a thickness of about 10 nm. On the other hand, when a lubricant is applied ten times, the layer thickness is considered to be sufficient.

Figure 16:
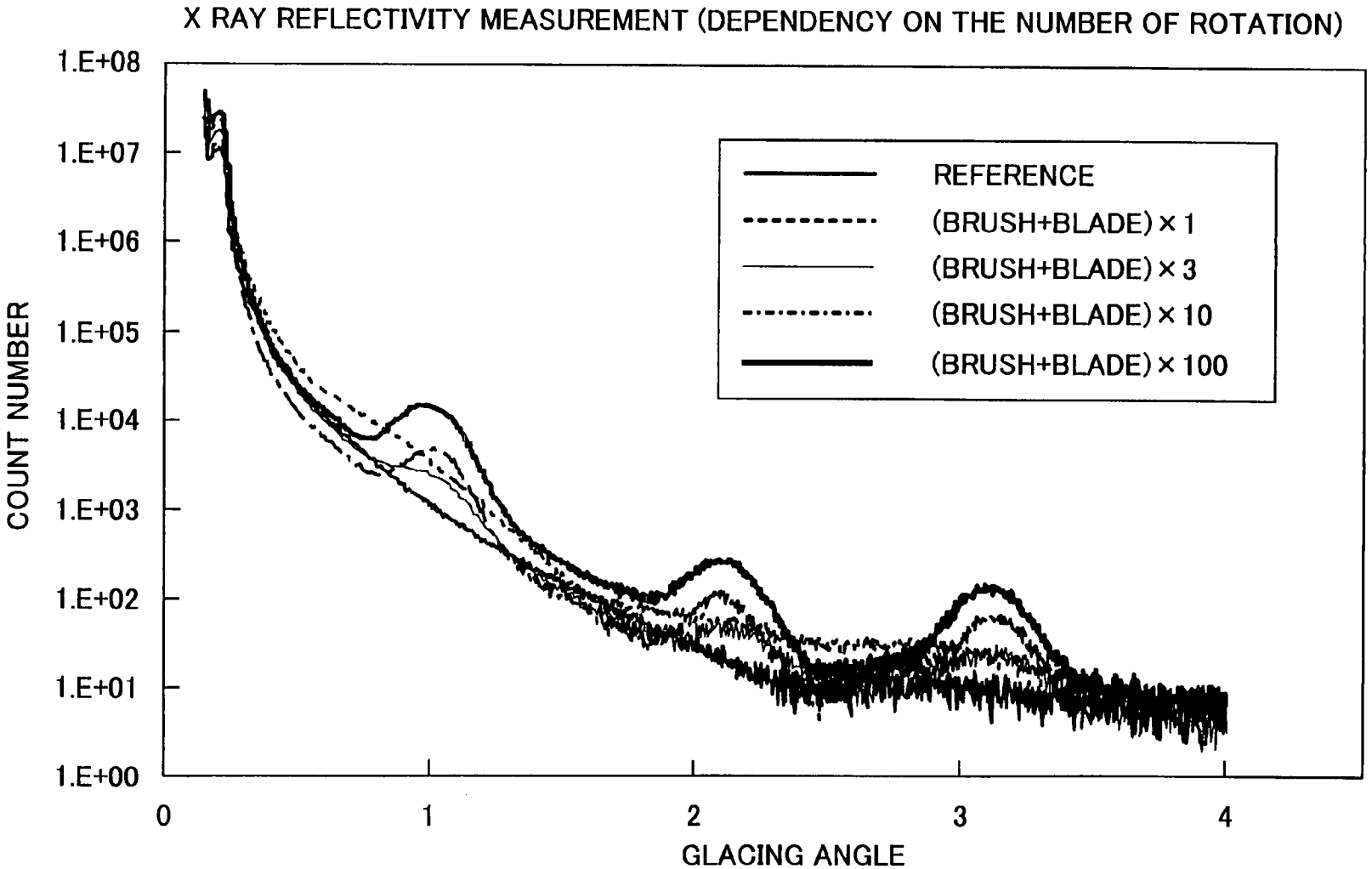
FIG. 16 is a graph illustrating one aspect of the relationship between the number of times a lubricant is applied on an image bearing member to the reflectivity thereof.

FIG. 16 is a graph measuring the reflectivity of the layer on the substrate using X rays. The vertical axis represents the reflectivity intensity and the horizontal axis represents the incident angle of X rays. The local peaks are observed where reflection from the surface of the layer overlaps with the reflection from the substrate. As seen in FIG. 16, when the application is performed only once, the local peak obtained is extremely small. Therefore, the layer thickness can be inferred to be insufficient. In addition, there is a difference in the reflection intensity between the case of three time application and the case of ten time application. Therefore, although the layer thickness obtained after ten time application is sufficient, the layer thickness obtained after three time application is determined to be not sufficient. The layer thickness obtained after ten time application is inferred to be sufficient.

Therefore, considering shortening the controlling time, the suitable number T of application times is represented by the following relationship (2):

$$3<T\leqq 10 \quad (2),$$

in the relationship, T represents an integer. The number of application times can be substituted with the number of rotation times of the photoreceptor (image bearing member).

FIG. 17 is a graph illustrating the case in which the lubricant is removed after application. The lubricant is not removed by ten time removal at all. However, the lubricant is considered to be slightly removed in the case of 50 time removal (50 time removal is equivalent to three time application shown in FIG. 17).

The relationship between a lubricant and abrasion is shown in Table 2.

TABLE 2

Relationship between lubricant and abrasion

| | PC (polycarbonate) applied before experiment | Toner applied before experiment | Continuously applied with a brush | Toner exchange | Abrasion speed (mg/10 h) |
|---|---|---|---|---|---|
| 1 | — | — | — | Exchanged to toner without ZnST | 18 |
| 2 | Yes | — | — | Exchanged to toner without ZnST | 22 |
| 3 | Yes | Yes | — | Exchanged to toner with ZnST | 2 |
| 4 | Yes | Yes | — | No exchange | 3 |
| 5 | Yes | Yes | Yes | No exchange | 4 |

This experiment was performed in such a manner that a polycarbonate (PC) substrate was abraded using an abrasion wheel to which a toner was attached.

From No. 4 in Table 2, it is found that the polycarbonate (PC) substrate to which the lubricant (ZnST) is applied is abraded little when the polycarbonate substrate is abraded with an abrasion wheel to which a toner having a lubricant thereon beforehand is attached. In addition, from No. 2 in Table 2, it is found that the polycarbonate (PC) substrate to which the lubricant (ZnST) is applied is abraded when the polycarbonate substrate is abraded with an abrasion wheel to which a toner not having a lubricant thereon is attached.

Further, FIG. 18 is a graph illustrating the abrasion results of the polycarbonate substrate No. 4 in Table 2 obtained by changing to an abrasion wheel to which a toner not having a lubricant thereon is attached in the middle of abrasion. It is found that abrasion starts when the toner is changed to a toner not having a lubricant thereon. Judging from the result, it can be determined that the lubricant attached to the polycarbonate substrate is removed by the toner. In addition, based on this results, it can be inferred that degraded lubricant is also removed by the toner.

Description Of Flow Charts

Figure 9A:
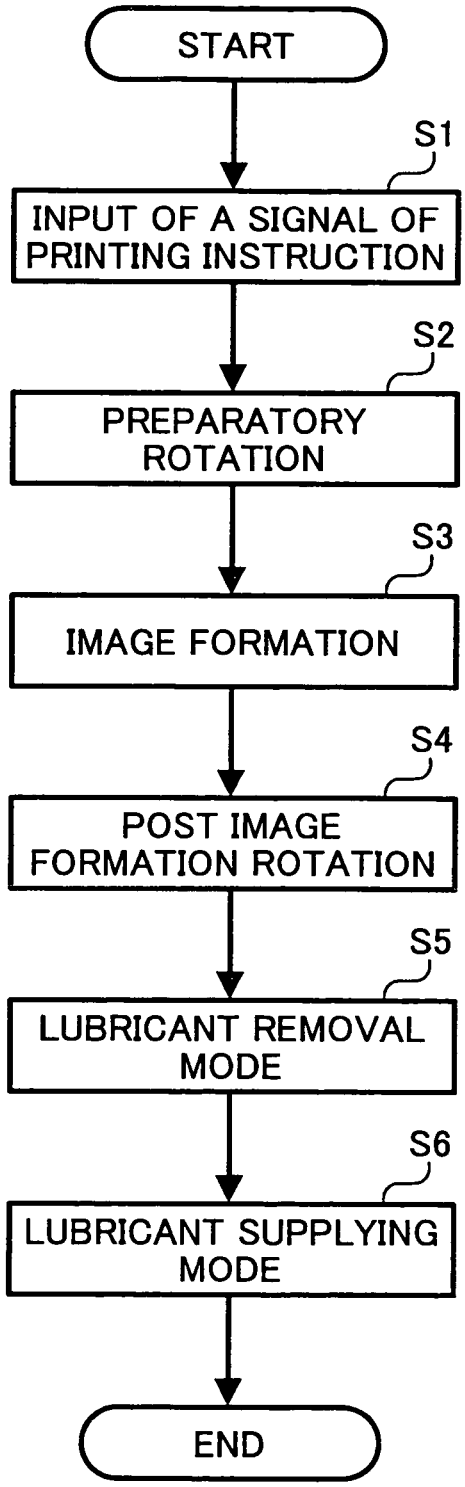
FIG. 9 is a high-level flow chart illustrating an example of the lubricant removing mode and lubricant supplying mode.
Figure 9B:
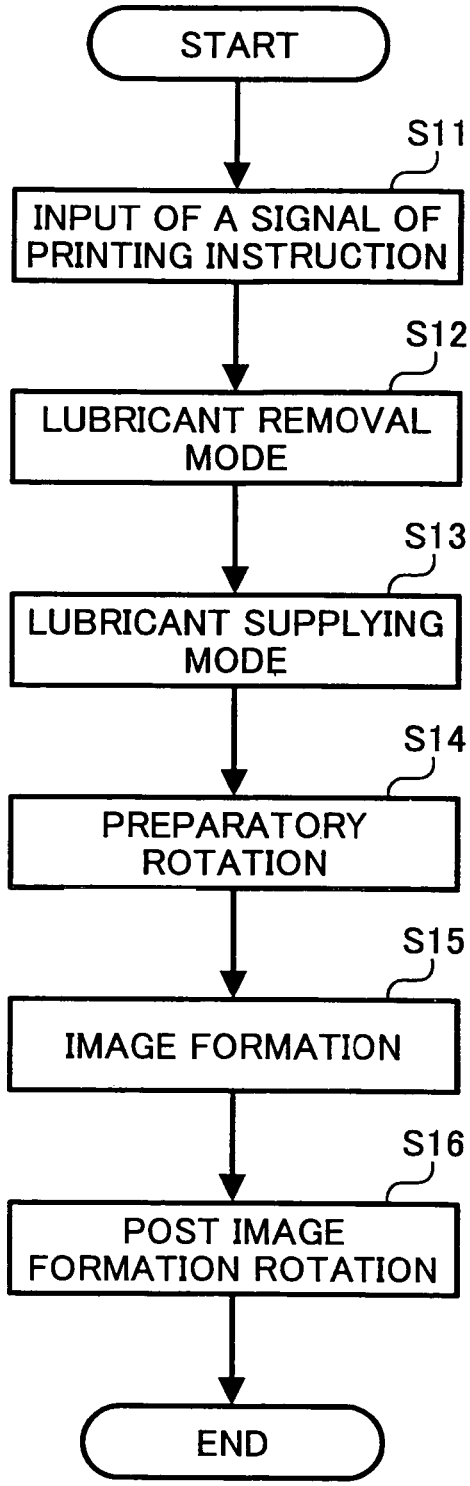

Flowcharts of the lubricant removing mode and the lubricant supplying mode are described below with reference to FIGS. 9A, 9B, 10A and 10B. FIGS. 9A and 9B correspond to the case A in which an image forming apparatus including an image bearing member to bear a latent image thereon, a charging device to charge the image bearing member and which includes a charging member provided in the vicinity of or in contact with the image bearing member, a transfer device to transfer the image to a transfer body, a lubricant supplying device to supply a lubricant to the surface of the image bearing member and which is disposed on the downstream side from the transfer device relative to the rotation direction of the image bearing member and on the upstream side from the charging member relative thereto, a developing device to develop the latent image with a developer and which is disposed on the downstream side from the charging member relative to the rotation direction of image bearing member and on the upstream side from the transfer device relative thereto, a discharging device to discharge the image bearing member, a cleaning device to clean the surface of the image bearing member and a controlling device to control an lubricant supplying mode and a lubricant removing mode in which the lubricant is removed from the surface of the image bearing member; and the case B in which an image forming method including charging the surface of an image bearing member with a charging device, irradiating a portion other than an image portion on the image bearing member with light by an irradiating device to form a latent electrostatic image, developing an image by supplying a developer to the latent electrostatic image with a developing device, transferring the developed image to a transfer body by a transfer device, fixing the transferred image on the transfer body by a fixing device, discharging the image bearing member with a discharging device, supplying a lubricant to the surface of the image bearing member, removing the developer remaining on the surface of the image bearing member with a cleaning device and controlling a lubricant supply mode and a lubricant removing mode to remove the lubricant on the image bearing member. FIGS. 10A and 10B correspond to the case C in which, in addition to the case A or B, the lubricant removing mode is triggered based on an operation period of time or a number of printed images. The difference between the flow charts illustrated in FIGS. 9*a* and 9*b* is when the lubricant removal and the lubricant supplying are performed. That is, image formation operation is performed before or after the lubricant removing mode and the lubricant supplying mode. The difference between the flowcharts illustrated in FIGS. 10A and 10B is the same as above. In FIGS. 9 and 10, the flowcharts illustrated in FIGS. 9A and 10A are preferred to those illustrated in FIGS. 9B and 10B in terms of the waiting time of a user. However, in terms of prevention of the occurrence of abnormal images or maintenance of the image quality, it can be said that the flowcharts illustrated in FIGS. 9B and 10B are preferred to those illustrated in FIGS. 9A and 10A.

The flowchart illustrated in FIG. 9A is described as follows: (Step S1) Receive a signal of a printing instruction at the image forming apparatus; (Step S2) Perform preparatory rotations of the image bearing member before image formation starts; (Step S3) Perform image formation; (Step S4) Perform the post image formation rotation to complete the image formation operation; (Step S5) Thereafter, start the lubricant removing mode to remove the lubricant on the image bearing member; and after the lubricant is removed, (Step S6) start the lubricant supplying mode to newly apply a lubricant to the image bearing member. Finally, the series of operations completes when a layer of the lubricant is formed on the image bearing member in the lubricant supplying mode.

The flowchart illustrated in FIG. 9B is described as follows: (Step S11) Receive a signal of a printing instruction at the image forming apparatus; (Step S12) Start the lubricant removing mode to remove the lubricant on the image bearing member; and after the lubricant is removed, (Step S13) start the lubricant supplying mode to newly apply a lubricant to the image bearing member: (Step S14) Perform preparatory rotation before image formation; (Step S15) Perform image formation; and (Step S16) Perform the post image formation rotation to complete the image formation operation.

The flowchart illustrated in FIG. 10A is described as follows: (Step S21) Receive a signal of a printing instruction at the image forming apparatus; (Step S22) Perform preparatory rotation before image formation starts; (Step S23) Perform image formation; (Step S24) Perform the post image formation rotation to complete the image formation operation; (Step S25) Thereafter, determine whether the preset time period has passed or the preset number of prints have been finished; (Step S26) When the answer to either of the preset conditions in Step S25 is Yes, start the lubricant removing mode to remove the lubricant on the image bearing member; and after the lubricant is removed, (Step S27) start the lubricant supplying mode to newly apply a lubricant to the image bearing member. Finally, the series of motions completes when a layer of the lubricant is formed on the image bearing member in the lubricant supplying mode. When the answer to both preset conditions in Step S25 is No, the series of operations completes without performing Steps S26 and S27.

The flowchart illustrated in FIG. 10B is described as follows: (Step S31) Receive a signal of a printing instruction at the image forming apparatus; (Step S32) Thereafter, determine whether the preset time period has passed or the preset number of prints have been finished; (Step S33) When the answer to either of the preset conditions in Step S32 is Yes, start the lubricant removing mode to remove the lubricant on the image bearing member; and after the lubricant is removed, (Step S34) start the lubricant supplying mode to newly apply a lubricant to the image bearing member: (Step S35) Perform preparatory rotations of the image bearing member before image formation starts; (Step S36) Perform image formation; (Step S37) Perform the post image formation rotation to complete the image formation operation; Finally, the series of motions completes when a layer of the lubricant is formed on the image bearing member in the lubricant supplying mode. When the answer to the preset conditions in Step S32 are No, the flowchart proceeds to Step S35 without performing Steps S33 and S34.

The difference between the flowcharts illustrated in FIGS. 9A and 9B and the flowcharts illustrated in FIGS. 10A and 10B is that while the lubricant removing mode and the lubricant supplying mode start in the flowcharts in FIGS. 9A and 9B every time an image is formed, the lubricant removing mode and the lubricant supplying mode start in the flowcharts in FIGS. 10A and 10B after a desired time period or a desired number of prints. The desired time period and the desired number of prints can be preset based on the how long it takes and how many images have been printed before the quality of an image starts to deteriorate or an abnormal image is produced. As an example other than the time period or the number of prints, the number of rotation of an image bearing member, etc. can be a trigger of the lubricant removing mode and the lubricant supplying mode. The desired time period and the desired number of prints vary depending on environment and the kind and the amount of toner, and further, the kind of recording material in the case of performing direct transfer. It is safe to preset a desired time period and a desired number of prints considering the shortest case scenario. It is found that entering into a lubricant removing mode and a supplying mode after about 20 to 30 prints is sufficient to maintain the thin layer of a lubricant when images are formed through indirect transfer. Considering the results mentioned above, it is possible to calculate the shortest time period based on the number of prints per day.

In this embodiment, the preparatory rotation is, for example, to raise the temperature of the fixing device, to determine an applied potential to the charging device, to determine an applied potential to the developing device, and to adjust the toner concentration. In addition, when a color image forming apparatus is used, color and positioning of images may be adjusted. Further, in the post image formation rotation, for example, toner remaining on the image bearing member after image formation is removed and the image bearing member is discharged.

Description Of Lubricant Removing Mode

To remove the lubricant on the surface of an image bearing member, it is effective to pressure-contact with the lubricant a member on which a lubricant is not attached. For example, the lubricant can be removed by pressure-contacting a transfer material (e.g., recording paper), an intermediate transfer belt, a transfer belt or a combination thereof with the image bearing member when lubricant is not attached to the transfer material, the intermediate transfer belt or the transfer belt. However, once a lubricant is attached to the members and devices mentioned above, the members mentioned above become less effective from the next time use forward because the amount of the lubricant removed decreases.

In one embodiment, a toner functioning as a developer is used to remove the lubricant remaining on an image bearing member. Since a lubricant is normally not attached to a toner, the toner is effective as a member for removing lubricant. In addition, it is from a developing device that such a toner is supplied to the image bearing member. The toner remaining on the image bearing member can be retrieved by a cleaning device or a transfer device.

However, there is a range of suitable amount of a toner attached to an image bearing member to remove a lubricant thereon. Therefore, it is preferred to control the amount of toner. When the developing bias applied during image formation is applied to control the amount of toner, the surface potential of an image bearing member is controlled by controlling the charging bias. In addition, when the charging bias applied during image formation is used, the developing bias is controlled. Further, it is possible to control both developing bias and charging bias. Furthermore, it is possible to control the amount of toner attached to the image bearing member by controlling the charge amount of toner. However, this method is not preferred because the control is complicated.

In embodiment, the suitable amount of toner for use in removing a lubricant is described. Preferably, the amount of a toner attached to the image bearing member is not less than 0.01 $mg/cm^2$. When the amount of a toner attached to the image bearing member is not less than 0.6 $mg/cm^2$, drawbacks may arise such that the amount of toner consumption increases, the toner scatters, cleaning at the cleaning portion becomes insufficient, and the toner clogs at toner transfer portion including the cleaning case. When the amount of a toner attached to the image bearing member is too small, the lubricant is not sufficiently removed. Therefore, the amount of a toner attached to the image bearing member is preferably from about 0.1 to about 0.6 mg/cm$^2$. Further, to restrain the amount of a toner consumed, the amount of a toner attached to the image bearing member is more preferably about 0.1 to about 0.3 mg/cm$^2$. When an image bearing member is rotated a predetermined number of times, a toner is attached to the image bearing member irrespective of the intention of an operator (the present application). But the amount of such a toner attached thereto is extremely small, which is 0.05 mg/cm$^2$ at maximum.

In addition, when a roller charging device is used, there are two charging bias types. One is DC overlapped with AC and the other is DC only. When a lubricant is removed or applied, DC only is preferred. One reason is that the number of discharging times is large when DC overlapped with AC is used. Therefore, the lubricant is degraded by the discharging. Therefore, even when DC overlapped with AC is used during image formation, DC only is preferred to be used when a lubricant is removed or applied.

In addition, with regard to the developing bias, there are two cases, which are also DC overlapped with AC and DC only. DC overlapped with AC is not preferred. This is because a stress to attract the toner attached to the image bearing member back to the developing device is produced. The toner attracted back to the developing device has a lubricant thereon. The lubricant attached to the toner attaches to a carrier, a developing roller, etc., in the developing device, thereby hindering charging of a toner.

When the toner retrieved at the cleaning portion is reused in the developing device, the lubricant attached to toner is removed by the cleaning device or at a retrieval transfer path. Therefore, when the toner is attracted back to the developing device, the amount of the lubricant attached thereto is small. Thus, the influence on the toner charging mentioned above is limited.

The values of the surface potential of an image bearing member and the developing bias to control the amount of the toner attached as mentioned above are described in detail. The voltage difference between the surface potential of the image bearing member and the developing bias is referred to as a developing potential. This developing potential is preferred to be from about 50 to about 400 V.

A case is described in which the developing bias (applied voltage to the image bearing member: Vdev) is the same as that during image formation and is not changed in the lubricant removing mode.

The developing potential mentioned above is suitable to limit the amount of a toner attached to an image bearing member within the value mentioned above. More specifically, this is achieved when the surface potential of an image bearing member is made to be smaller in absolute value than the developing bias and larger in absolute value than the irradiation voltage during image formation. However, the suitable surface potential set for an image bearing member depends on whether a toner used is a single-component developer or a two-component developer, the amount of the charge of a toner, etc.

Below is a case in which the developing bias is the same as that in image formation and a two-component developer is used. In this case, only the surface potential (Vh) of an image bearing member is changed. The surface potential of an image bearing member is controlled by a voltage (charging bias: Vch) applied to a charging device. In addition, when instead of a corona charger such as a charging roller or a charging blade, but a charging device contacting or disposed in the vicinity of an image bearing member is used, the charging bias is preferably set to satisfy the following relationship (1):

$$|Vth| \leqq |Vch| \leqq |Vth| + |Vdev| \quad (1$$

Further, it is preferred to set the charging bias based on the following relationship (3) to restrain the amount of toner attached in a suitable range.

$$|Vth| + 150 \leqq |Vch| < |Vth| + |vdev| - 50 \quad (3)$$

In addition, when a coroner charger is used, it is preferred to control the voltage applied to the grid to obtain the developing potential mentioned above.

Below is a case in which the surface potential of an image bearing is the same as that during image formation and the developing bias is changed in the lubricant removing mode.

The developing bias can be changed by providing a power supply which can change the voltage applied to an image bearing member. The developing bias applied during image formation is changed in the lubricant removing mode by controlling the power supply mentioned above by a controller. As mentioned above, when the developing bias is DC overlapped with AC, it is preferred not to apply AC.

When the developing bias is changed, the charging bias is preferred to be DC only. Attention should be paid to the fact that when only DC in DC overlapped with AC is simply applied to an image bearing member, the surface potential thereof is not the same as that in image formation.

Below is an example of when an image bearing member is charged at 700 V.

DC overlapped with AC
DC: Vdc=700 V
AC: Vpp=2.2 kV, f=1 kHz
DC only
DC: Vdc=1400 V
Vth is assumed to be 700 V.

Description of set voltage in lubricant supplying mode

Below is the description of the value of the applied voltage set in the lubricant supplying mode in the flowcharts in FIGS. 9 and 10.

Especially, a case is described below in which a detachment-attachment mechanism is not provided to a developing device, and a charging device having a charging member contacting with or disposed in the vicinity of an image bearing member is used.

For example, when the charging voltage (Vh) of an image bearing member during image formation is set to be −800 V, the voltage at an irradiated printed portion is −150 V, the voltage applied to a developing device is −450 V, the toner is negatively charged, and the voltage applied to the developing device is applied in the lubricant supplying mode, the voltage (Vch) applied to the charging device is preferred to be without overlapping AC and set in the range in which the charging voltage (Vh) of the image bearing member satisfies the following relationship (4). That is, it is preferred to set the charging voltage (Vh) of the image bearing member lower than the voltage applied to the developing device. Further, it is preferred to set Vh to be a voltage about 100 V lower than the voltage (−450 V in the case mentioned above) applied to the developing device. That is, Vh is preferred to be set about −550 V.

$$-450V > Vh > -800V \quad (4)$$

However, with regard to −800 V, which is the lower limit thereof, when the developing device has a sufficient ability to further charge an image bearing member, the range of Vh can be extended to the limit. For example, with a developing device having an ability for −1,200V, Vh can be −1,200 V as well. With such a value, toner attachment to an image bearing member can be prevented and easily form a thin layer of lubricant.

The voltage (Vch) applied to a developing device satisfying the relationship (1) varies depending on the layer thickness of the photoreceptor of an image bearing member. The value obtained from the image bearing member used in the experiment roughly satisfies the following relationship (5).

$$-1150V > Vch > -1500V \quad (5)$$

Next, when the developing device is grounded in the lubricant supplying mode instead of being applying the voltage during image formation thereto, it is preferred to apply the voltage (Vch) to a developing device without overlapping AC and set the voltage (Vch) in the range in which the charging voltage (Vh) of the image bearing member satisfies the following relationship (6). Further, it is preferred to set Vh to a value about 100 V lower than the voltage (i.e., 0 V in the case mentioned above) applied to the developing device. That is, Vh is preferred to be not greater than −100 V.

$$0V > Vh > -800V \quad (6)$$

However, with regard to −800 V, which is the lower limit thereof, when the developing device has a sufficient ability to further charge an image bearing member, the range of Vh can be extended to the limit. For example, with a developing device having an ability for −1,200V, Vh can be −1,200 V as well. With such a value, toner attachment to an image bearing member can be prevented and easily form a thin layer of lubricant.

The voltage (Vch) applied to a developing device satisfying the relationship (3) varies depending on the layer thickness of the photoreceptor of an image bearing member. The value obtained from the image bearing member used in the experiment roughly satisfies the following relationship (7).

$$0V \geqq Vch > -1500V \quad (7)$$

However, in the relationships (5) and (7), there is a possibility that discharging occurs between the charging device and the image bearing member. When such discharging occurs, a thin layer of lubricant is difficult to form on the image forming apparatus. Therefore, to prevent discharging between the charging device and the image bearing member, there is a method in which only discharging to the image bearing member is performed and charging thereto by the charging device is not performed.

In the case described above, negative charging is adopted. When positive charging is performed, the inequality sign is reversed. Description of cross-linkage type protective layer of image bearing member As the binder structure of the protective layer of an image bearing member, a protective layer having a cross-linkage structure is effectively used. Cross linkage structure is formed in such a manner that a cross linkage reaction is performed with light and thermal energy using a reactive monomer having multiple cross-linkage functional groups in one molecule to form a three-dimensional mesh structure. This mesh structure functions as a binder resin and exercises a high anti-abrasion property. In terms of electric stability, anti-abrasion, and life, it is extremely effective to use a monomer partially or entirely having a charge transport ability as the reactive monomer mentioned above. By using such a monomer, charge transport portions are formed in the mesh structure so that the function as a protective layer can be fully exercised.

Specific examples of such reactive monomers include compounds having at least one charge transport component and at least one silicon atom having a hydrolytic substituent group in the same molecule, compounds having a charge transport component and a hydroxyl group in the same molecule, compounds having a charge transport component and a carboxylic group in the same molecule, compounds having a charge transport component and an epoxy group in the same molecule, and compounds having a charge transport component and an isocyanate group in the same molecule. These charge transport materials having a reactive group can be used alone or in combination.

It is further preferred to use a reactive monomer having a triaryl amine structure because, as a monomer having a charge transport ability, such a reactive monomer is electrically and chemically stable, the transfer speed of carrier is high, etc.

Other than these, a polymeric monomer or a polymeric oligomer having one or two functional groups can be used in combination with the reactive monomer mentioned above to impart functions of adjusting viscosity during application, relaxing the stress in cross-linkage type charge transport layer, reducing the surface energy, decreasing the friction index, etc. Known polymeric monomers and oligomers can be used.

In this embodiment, compounds in which positive holes are transferred are polymerized or cross-linked using light or thermal energy. When polymerization is performed using heat, there are two cases, which are polymerization with only thermal energy and with thermal energy together with a polymerization initiator. To perform the polymerization at a low temperature, it is preferred to add a polymerization initiator.

When polymerization is performed using light, it is preferred to use ultraviolet rays as the light. However, it is rare that polymerization proceeds with only light. Therefore, in general, an optical polymerization initiator is used in combination with light. The optical polymerization initiator is a compound that initiates polymerization by absorbing ultraviolet rays having a wavelength of not greater than 400 nm to form active species such as radicals and ions. In this embodiment, it is possible to use the thermal and optical polymerization initiators mentioned above in combination.

The charge transport layer having the mesh structure formed as mentioned above has a good anti-abrasion property. However, such a layer significantly contracts in size during cross-linkage reaction so that cracking and so on may occur when too thick a layer is formed. In such a case, it is possible to have a layered protective layer. In such a layered protective layer, its bottom (photosensitive layer side) layer is formed of a polymer in which low molecular weight molecules are dispersed, and its upper (surface side) layer has a cross linkage structure.

Below are examples of the photoreceptors (image bearing member) using the cross-linkage type protective layer mentioned above. In the descriptions in the following examples, the numbers represent weight ratios in parts, unless otherwise specified.

Electrophotographic Photoreceptor A

Electrophotographic photoreceptor A was manufactured in the same manner as illustrated in the electrophotographic photoreceptor mentioned above except that the liquid for application for a protective layer, the layer thickness and manufacturing conditions were changed as follows.

The following components were mixed to prepare a liquid for application for a protective layer. This liquid for application was applied to the charge transport layer and dried. The resultant was cured and dried with heat at 110° C. for one hour and a protective layer having a thickness of 3 μm was formed.

| | |
|---|---|
| Methyl trimethoxy silane | 182 parts |
| Dihydroxymethyl triphenylamine | 40 parts |
| 2-propanol | 225 parts |
| 2% acetic acid | 106 parts |
| Aluminum tris-acetyl acetate | 1 part |

Electrophotographic Photoreceptor B

Electrophotographic photoreceptor B was manufactured in the same manner as illustrated in the electrophotographic photoreceptor mentioned above except that the liquid for application for the protective layer, the layer thickness and manufacturing conditions were changed as follows.

Thirty parts of a positive hole transport compound having the following chemical formula (I), 0.6 parts of acrylic monomer having the following chemical formula (II) and 0.6 parts of an optical polymerization initiator (1-hydroxy-cyclohexyl-phenyl-ketone) were dissolved in a mixture solvent containing 50 parts of monochloro benzene and 50 parts of dichloromethane to prepare a liquid for application for a surface protective layer. This liquid for application was applied to the charge transport layer mentioned above by a spray coating method. The resultant was cured by a metal halide lamp with a light intensity of 500mW/cm$^2$ for 30 seconds to form a surface protective layer having a thickness of 5 μm.

[Chemical Formulae 1]

Chemical formula (I)

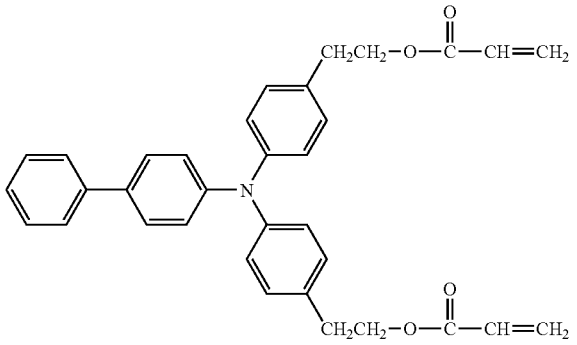

Chemical formula (II)

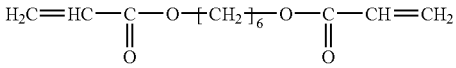

The structures illustrated in FIGS. 1 to 7 are described.

FIGS. 1 to 7 are diagrams illustrating examples of the image forming apparatus operated in the lubricant supplying mode. The lubricant removing mode and the lubricant supplying mode can be applied to other cases than those illustrated in FIGS. 1 to 7. The structure illustrated in FIG. 1 is the simplest structure, which is used based on a typical current marketed image forming apparatus. In the structure, the toner remaining on an image bearing member 2 is removed by a fur brush 7-1 and lubricant is supplied by a lubrication member (lubricant) 102 which contacts with the fur brush 7-1. In addition, a cleaning device (cleaning blade) 7 is provided on the downstream side from the image bearing member relative to the rotation direction thereof to remove remaining toner which has passed through the fur brush 7-1. This cleaning blade not only removes the toner remaining after transfer but also forms a thin layer of lubricant. A control unit 11 controls the function of supplying and removing a lubricant in a lubricant supplying mode and a lubricant removing mode.

In addition to the structure illustrated in FIG. 1, the structure illustrated in FIG. 2 further has another lubricant supplying device 103. In FIG. 2, the lubricant supplying device 103 is provided in a suitable vicinity of the image bearing member 2 such that the lubricant supplying device 103 can rotate against the image bearing member 2 while both are in contact. The lubrication member 102 is made in contact with the lubricant supplying device 103, i.e., application brush 103, by a pressure spring (not shown). As a lubricant, for example, zinc stearate issued. The application brush 103 function in gas a lubricant supplying device scrapes the lubrication member 102 to apply the scraped lubricant to the surface of the image bearing member 2. Application of lubricant becomes easy by having such a structure in which lubricant is applied after toner has been removed. As illustrated in FIG. 1, the control unit 11 controls the function of supplying and removing a lubricant in a lubricant supplying mode and a lubricant removing mode.

The structure illustrated in FIG. 3 further has a lubricant layer uniforming device 110 in addition to the structure illustrated in FIG. 2. Uniforming a lubricant layer becomes easy by having such a structure.

Figure 4:
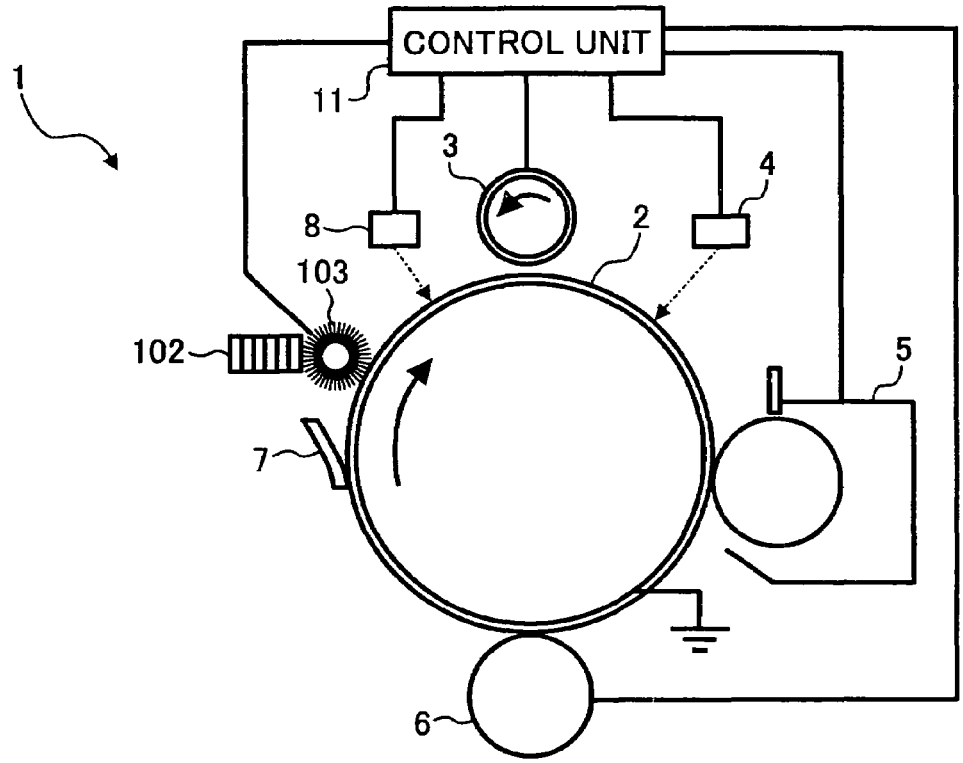
FIG. 4 is a schematic diagram illustrating another example of an image bearing member of the monochrome image forming apparatus of the present application.

The structure illustrated in FIG. 4 is a structure in which the fur brush 7-1 is removed from the structure illustrated in FIG. 2. The ability to remove the toner remaining after transfer deteriorates but still stays at a sufficient level.

Figure 5:
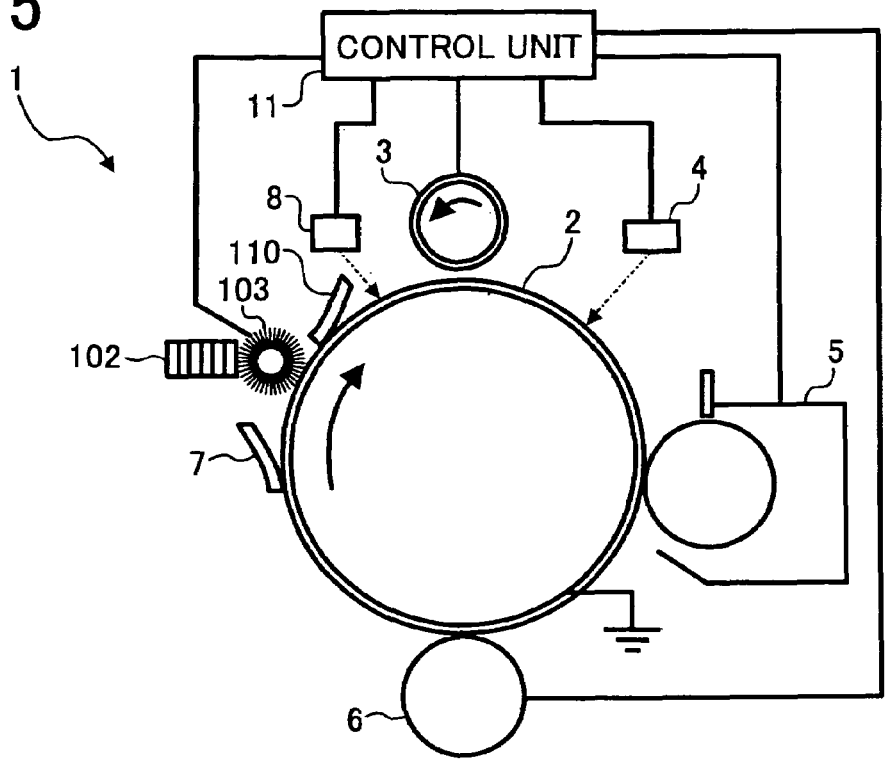
FIG. 5 is a schematic diagram illustrating another example of an image bearing member of the monochrome image forming apparatus of the present application.

The structure illustrated in FIG. 5 is a structure in which the fur brush 7-1 is removed from the structure illustrated in FIG. 3. The ability to remove the toner remaining after transfer deteriorates but still stays at a sufficient level.

Figure 6:
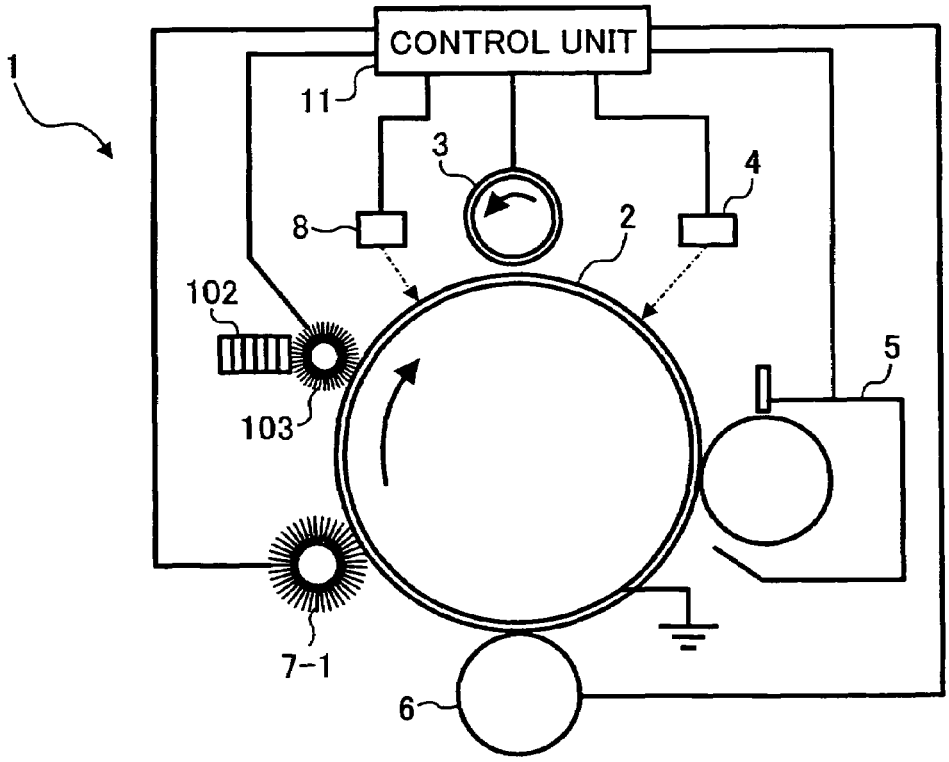
FIG. 6 is a schematic diagram illustrating another example of an image bearing member of the monochrome image forming apparatus of the present application.

The structure illustrated in FIG. 6 is a structure in which the cleaning blade 7 is removed from the structure illustrated in FIG. 2. The ability to remove the toner remaining after transfer deteriorates but can be maintained at the same level as that of a cleaning blade by applying a voltage to the fur brush 7-1 or providing another fur brush in front of the fur brush 7-1. When an image forming apparatus for low speed imaging with a small quantity is used, the fur brush 7-1 has a sufficient cleaning ability therefor.

Figure 7:
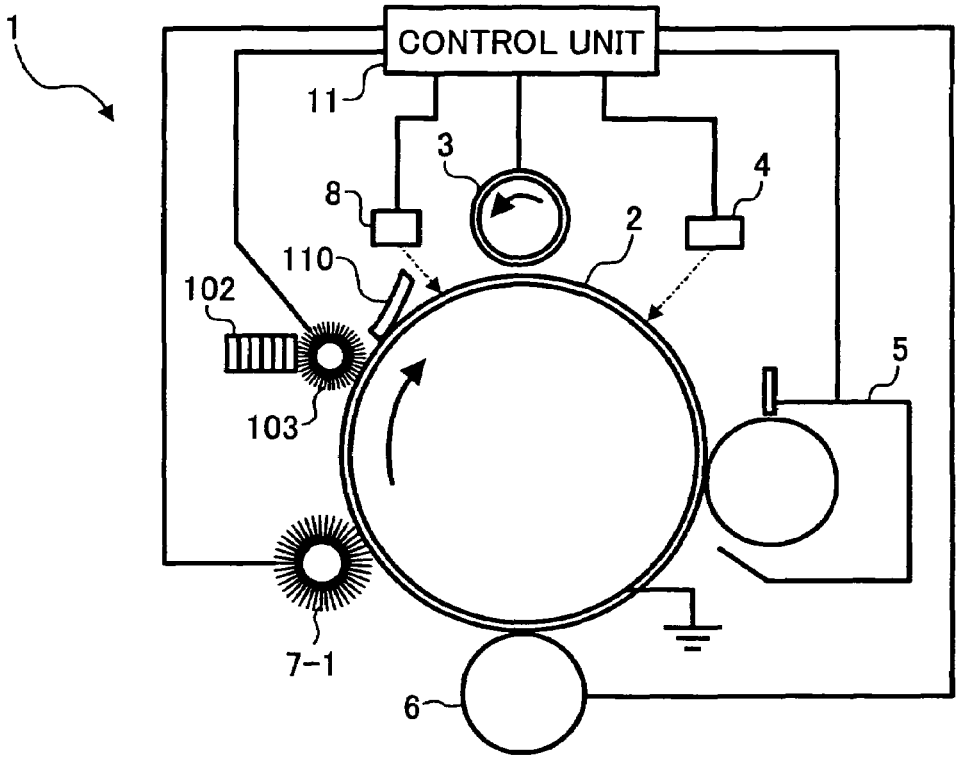
FIG. 7 is a schematic diagram illustrating another example of an image bearing member of the monochrome image forming apparatus of the present application.

The structure illustrated in FIG. 7 is a structure in which the cleaning blade 7 is removed from the structure illustrated in FIG. 3. Its cleaning performance is as described for FIG. 6. Uniforming a lubricant layer is better than the structure illustrated in FIG. 6.

The blade for use in lubricant layer uniforming device can be formed of materials forming a cleaning blade. That is, known materials such as polyurethane rubber, silicon rubber, nitrile rubber, chloroprene rubber can be used. In addition, such a blade preferably has an elasticity of from 20 to 80%, a thickness of from 1 to 6 mm, and a contact angle against an image bearing member of from 15° to 45°.

The rotation direction of the fur brush 7-1 contacting with the lubricant supplying device 103 or the lubrication member 102 illustrated in FIGS. 1 to 7 is preferably clockwise but can be counterclockwise. In addition, when the speed of the surface of the image bearing member 2 is represented by V1, it is preferred to have the speed V2 of the brush roller in the following range (8):

$$0.5\times V1 \leqq V2 \leqq 5\times V1 (V1 \# V2) \quad (8).$$

When such a brush roller is used, the brush roller preferably has a density of from 2,000 to 10,000 strings/cm$^2$ and more preferably from 3,000 to 8,000 strings/cm$^2$. The lower limit thereof is determined based on the result of an experiment for the occurrence of an abnormal image by an image bearing member. The upper limit thereof simply represents the limit in terms of the current manufacturing technology and can be higher as the manufacturing technology is improved. Therefore, the upper limit thereof is not necessarily limited.

What state of the lubricant should be achieved on the image bearing member 2 by the lubricant removing mode and the lubricant supplying mode mentioned above is not completely understood. However, it is found that it is possible to prevent degeneration (white turbidity) of the surface of a charged body (the image bearing member 2) when the ratio (%) of the metal elements contained in a metal salt of a fatty acid present on the surface of the image bearing member 2 is not less than the value represented by (9) based on XPS measurement:

$$1.52\times10^{-4}\times\{Vpp-2\times Vth\}\times f/v(\%) \quad (9).$$

In the relationship (9), Vpp represents the amplitude (V) of the AC component applied to a charging member, f represents the frequency (Hz) of the AC component applied to a charging member, Gp represents the closest distance (μm) between the surface of a charging member and the surface of a charged body, v represents the moving speed (mm/sec) of the surface of a charged body opposing a charging member, and Vth represents the initial discharging voltage. In addition, the value of Vth is $312+6.2\times(d/\in opc+Gp/\epsilon air)+\sqrt{(7737.6\times d/\in)}$, wherein d (μm) represents the pressure of the layer of a charged body, ∈opc represents the specific dielectric constant of a charged body, and ∈air represents the specific dielectric constant of the space between a charged body and a charging member.

Figure 8:
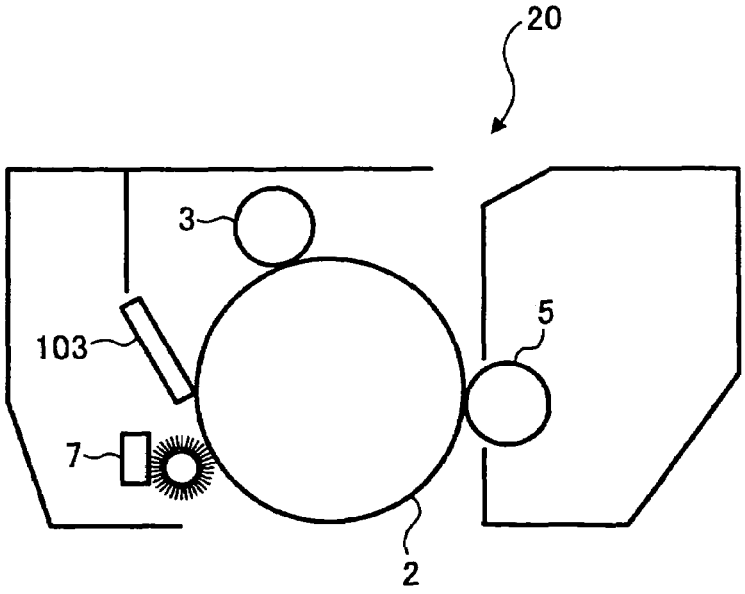
FIG. 8 is a diagram illustrating an example of the process cartridge of the present application.

In the image forming apparatus illustrated in FIG. 8, a casing rotationally supporting the charging device 3 and a cleaning case supporting the cleaning device 7 are structured as an integrated unit case. The image bearing member 2 is rotationally assembled in the unit case. An image forming unit is formed by integrally assembling the charging device 3 and the image bearing member 2. This image formation unit is detachably attached to the main body of an image forming apparatus. In FIG. 15, the charging device 13 and the image bearing member 2 are assembled in the unit case with the minute gap G thererbetween constantly maintained. The image formation unit can be detachably attached to the main body of an image forming apparatus with this gap G constantly maintained. Therefore, the drawback that the minute gap G varies when the image formation unit is detached or attached can be prevented. It is also possible to have a structure in which the image bearing member 2 and the charging device 3 are separately detached or attached to the main body of an image forming apparatus. However, uniform charging may not be performed in this structure since the minute gap G may vary therein when the image bearing member and the charging device 3 are attached or detached.

In addition, the image formation unit of the embodiment has another member contacting with the image bearing member 2 in addition to the charging device 3. As illustrated in FIG. 8, the cleaning case and the casing integrally form a unit case as mentioned above. The lubricant supplying device 103 is assembled in the unit case. It is preferred to assemble a charging device and a lubricant removal device to the unit case mentioned above although these devices are not shown.

These members form members contacting the image bearing member 2 can be detached or attached to the main body of an image forming apparatus on a separate occasion with the image bearing member 3. However, when a contacting member is detached or attached, these contacting members move while in contact with the image bearing member 2. Therefore, the image bearing member 2 receives a great stress from outside, which may change the minute gap G. To the contrary, when the contacting members such as the cleaning blade, the lubricant supplying device 103, and the lubricant supplying device are contained as the elements of an image formation unit, the contacting members are detached or attached together when the image formation unit is detached or attached to the main body of an image bearing member. Therefore, these contacting members are relatively immovable based on the image bearing member 2. Therefore, the minute gap G does not vary so that the image bearing member 2 is prevented from being scarred or scratched by the contact.

In addition, when the image bearing member 2 is structured as an organic photoreceptor having a surface layer reinforced by a filling material such as aluminum powder having a diameter of not greater than 0.1 μm, an organic photoreceptor using a cross-linkage charge transport material, or an organic photoreceptor having both characteristics, its surface hardness is improved. Therefore, anti-abrasion property thereof is improved, which leads to a long life of the image bearing member 2.

In one embodiment, the degraded lubricant or the nonfunctional lubricant remaining on the surface of the image bearing member 2 can be surely removed to prevent the deterioration of the quality of images and the occurrence of abnormal images.

In addition, the lubricant layer on the image bearing member 2 can be easily removed by suitably controlling the attachment of toner to the image bearing member 2.

In one embodiment, it is possible to prevent the lubricant from entering into the developing device (unit) by applying a DC developing bias. Further, by applying a lubricant to the image bearing member 2, the image bearing member is protected from discharging of the developing device. The image bearing member 2 has a protective layer on its surface so that the amount of layer scraping decreases.

In one embodiment, the scraped amount of layer of the image bearing member 2 further can be decreased due to the binder resin having a cross-linkage structure contained in the protective layer of the image bearing member 2. In addition, the quality of images can be improved because the binder resin having a cross-linkage structure contained in the protective layer of the image bearing member 2 includes a charge transport portion.

In one embodiment, by forming a process cartridge for use in an image forming apparatus integrally including the image bearing member 2, the lubricant removal device and the lubricant supplying device, the serviceability is improved as well as it becomes easy to maintain the contacting state between the image baring member 2 and the lubricant supplying device 103.

This document claims priority and contains subject matter related to Japanese Patent Application No. 2005-074351, filed on Mar. 16, 2005, the entire contents of which are incorporated herein by reference.

Having now fully described embodiments of the present invention, it will be apparent to one of ordinary skill in the art that many changes and modifications can be made thereto without departing from the spirit and scope of embodiments of the invention as set forth herein.

What is claimed as new and desired to be secured by letters patent of the United States is:

1. An image forming method, comprising:

charging a surface of an image bearing member with a charging device;

irradiating a portion of the image bearing member other than an image portion with light by an irradiating device to form a latent electrostatic image;

developing an image by supplying a developer to the latent electrostatic image with a developing device;

transferring the developed image to a transfer body by a transfer device; fixing the transferred image on the transfer body by a fixing device;

discharging the image bearing member with a discharging device;

supplying a lubricant to the surface of the image bearing member;

removing the developer remaining on the surface of the image bearing member with a cleaning device;

controlling a lubricant removing mode to remove the lubricant on the image bearing member;

discharging the surface of the image bearing member with the discharging device such that a voltage of the image bearing member is close to 0 V in absolute value, and supplying the developer for removing the lubricant with the developing device to the surface of the image bearing member by applying a bias smaller in absolute value than a development bias applied thereto during image formation.

2. The image forming method according to claim 1, wherein the lubricant removing mode is triggered based on an operation period of time or a number of printed images.

3. The image forming method according to claim 1, wherein the supplying includes applying the lubricant immediately after the lubricant is removed.

4. The image forming method according to claim 1, wherein the lubricant removed from the surface of the image bearing member is a degraded lubricant.

5. An image forming method, comprising:

charging a surface of an image bearing member with a charging device;

irradiating a portion of the image bearing member other than an image portion with light by an irradiating device to form a latent electrostatic image;

developing an image by supplying a developer to the latent electrostatic image with a developing device;

transferring the developed image to a transfer body by a transfer device; fixing the transferred image on the transfer body by a fixing device;

discharging the image bearing member with a discharging device;

supplying a lubricant to the surface of the image bearing member;

removing the developer remaining on the surface of the image bearing member with a cleaning device;

controlling a lubricant removing mode to remove the lubricant on the image bearing member, and supplying the developer to the image bearing member with the wherein a voltage (Vch) applied to the charging device comprises only a DC component while satisfying the following relationship (1):

$$|Vth| \leqq |Vch| \leqq |Vth| + |Vdev| \quad (1),$$

wherein, Vth represents a voltage when charging starts, and Vdev represents a development bias, which is the applied voltage of the DC component to the developing device.

6. The image forming method according to claim 5, wherein the lubricant removing mode is triggered based on an operation period of time or a number of printed images.

7. The image forming method according to claim 5, wherein the supplying includes applying the lubricant immediately after the lubricant is removed.

8. The image forming method according to claim 5, wherein the lubricant removed from the surface of the image bearing member is a degraded lubricant.

9. An image forming method, comprising:

charging a surface of an image bearing member with a charging device;

irradiating a portion of the image bearing member other than an image portion with light by an irradiating device to form a latent electrostatic image;

developing an image by supplying a developer to the latent electrostatic image with a developing device;

transferring the developed image to a transfer body by a transfer device; fixing the transferred image on the transfer body by a fixing device;

discharging the image bearing member with a discharging device;

supplying a lubricant to the surface of the image bearing member;

removing the developer remaining on the surface of the image bearing member with a cleaning device; and controlling a lubricant removing mode to remove the lubricant on the image bearing member, wherein a surface voltage of the image bearing member is the same as the surface voltage thereof during the irradiating, an applied voltage to the charging device comprises only a DC component without an AC component, and the developing device supplies the developer to the image bearing member with a bias greater in absolute value than the bias during image formation.

10. The image forming method according to claim 9, wherein the lubricant removing mode is triggered based on an operation period of time or a number of printed images.

11. The image forming method according to claim 9, wherein the supplying includes applying the lubricant immediately after the lubricant is removed.

12. The image forming method according to claim 9, wherein the lubricant removed from the surface of the image bearing member is a degraded lubricant.

* * * * *